US010967998B2

(12) United States Patent
Jorge Alesanco

(10) Patent No.: US 10,967,998 B2
(45) Date of Patent: Apr. 6, 2021

(54) WORK STATION FOR A PACKAGING LINE AND A PACKAGING LINE COMPRISING AT LEAST TWO OF SAID WORK STATIONS

(71) Applicant: NEXES CONTROL DESIGN ENGINEERING S.L.U., Sant Joan Despi (ES)

(72) Inventor: Cristobal Jorge Alesanco, Barcelona (ES)

(73) Assignee: NEXES CONTROL DESIGN ENGINEERING S.L.U., Sant Joan Despi (ES)

( * ) Notice: Subject to any disclaimer, the term of this patent is extended or adjusted under 35 U.S.C. 154(b) by 489 days.

(21) Appl. No.: 15/551,993

(22) PCT Filed: Mar. 8, 2016

(86) PCT No.: PCT/ES2016/070144
§ 371 (c)(1),
(2) Date: Aug. 18, 2017

(87) PCT Pub. No.: WO2016/142564
PCT Pub. Date: Sep. 15, 2016

(65) Prior Publication Data

US 2018/0029733 A1 Feb. 1, 2018

(30) Foreign Application Priority Data

Mar. 9, 2015 (ES) ..... ES201530297

(51) Int. Cl.
*B65B 35/36* (2006.01)
*B65B 61/28* (2006.01)
(Continued)

(52) U.S. Cl.
CPC ..... *B65B 35/36* (2013.01); *B65B 7/16* (2013.01); *B65B 61/28* (2013.01); *B65B 65/003* (2013.01);
(Continued)

(58) Field of Classification Search
CPC ..... B65B 35/36; B65B 7/16
(Continued)

(56) References Cited

U.S. PATENT DOCUMENTS 4,974,392 A * 12/1990 Mondini ..... B65B 7/164 198/468.1
5,065,563 A * 11/1991 Robache ..... B29C 66/84121 53/282
(Continued)

FOREIGN PATENT DOCUMENTS

EP 2 208 672 A1 7/2010
EP 2208672 A1 * 7/2010 ..... B65G 25/02
(Continued)

OTHER PUBLICATIONS

International Search Report for PCT/ES2016/070144, dated Jul. 18, 2016 (PCT/ISA/210).
(Continued)

*Primary Examiner* — Chelsea E Stinson
(74) *Attorney, Agent, or Firm* — Sughrue Mion, PLLC

(57) ABSTRACT

A work station (40) for a packaging line having an apparatus (4) for executing a simultaneous action on packages (10) of an alignment of packages with a tool (46); and a transfer mechanism (31) for the simultaneous transport of an alignment of packages to be processed (10*b*) to the apparatus (4) and of an alignment of processed packages (10*c*) from the apparatus (4). The alignments are arranged parallel to each other and the transport direction of the packages are perpendicular to the alignments, the transfer mechanism (31)
(Continued)

thus having a first and a second transport group (31*a*, 31*b*), one of which hangs from two movable parts (60) of the transfer mechanism (31) which are movable on respective parallel planes of movement and which do not interfere with the vertical projection of the tool (46). A packaging line (101, 102, 103) with modular construction having such work stations.

20 Claims, 15 Drawing Sheets

(51) Int. Cl.

| | |
|---|---|
| ***B65B 7/16*** | (2006.01) |
| ***B65B 65/00*** | (2006.01) |
| *B65B 31/02* | (2006.01) |
| *B65B 31/04* | (2006.01) |
| *B65B 57/00* | (2006.01) |

(52) U.S. Cl.
CPC ..... *B65B 65/006* (2013.01); *B65B 31/025* (2013.01); *B65B 31/041* (2013.01); *B65B 57/00* (2013.01); *B65B 2210/02* (2013.01)

(58) Field of Classification Search
USPC ..... 53/299
See application file for complete search history.

(56) References Cited

U.S. PATENT DOCUMENTS

| | | | | |
|---|---|---|---|---|
| 5,475,965 | A * | 12/1995 | Mondini | B29C 66/131 53/287 |
| 2012/0144785 | A1 * | 6/2012 | Vaccari | B65B 31/028 53/510 |
| 2014/0069054 | A1 | 3/2014 | Gabler | |

FOREIGN PATENT DOCUMENTS

| | | | |
|---|---|---|---|
| EP | 2 500 276 | A1 | 9/2012 |
| EP | 2 706 012 | A1 | 3/2014 |
| WO | 2014/199161 | A1 | 12/2014 |

OTHER PUBLICATIONS

Written Opinion of the International Searching Authority for PCT/ES2016/070144, dated Jul. 18, 2016 (PCT/ISA/237).

* cited by examiner

WORK STATION FOR A PACKAGING LINE AND A PACKAGING LINE COMPRISING AT LEAST TWO OF SAID WORK STATIONS

CROSS REFERENCE TO RELATED APPLICATIONS

This application is a National Stage of International Application No. PCT/ES2016/070144 filed Mar. 8, 2016, claiming priority based on Spanish Patent Application No. P 201530297, filed Mar. 9, 2015, the contents of all of which are incorporated herein by reference in their entirety.

TECHNICAL SECTOR OF THE INVENTION

The present invention belongs to the field of packaging and more particularly to a work station of the type which carries out a simultaneous action on a determined number of aligned packages and which requires the use of a tool which operates above the packages.

The invention also relates to a packaging line which requires more than one operation to be executed on the packages of the line, such as for example a combination of the operations of sterilizing, filling, closing and testing water-tightness and which, to do this, uses at least two work stations according to the invention conveniently connected to each other in order to give continuity to the line.

BACKGROUND OF THE INVENTION

At present, there are multiple options for implementing a packaging line, the characteristics of which vary widely according to the typology of the packages and the operations which are required to complete the packaging. Thus, for example, the use of rotary work stations which operate continuously to manipulate and carry out operations on bottles on packaging lines for childcare products such as infant milks or follow-on milks is usual; and the use of lines with intermittent advance for manipulating and carrying out operations on tray type packages intended to contain various food products.

These examples have in common the need to use tools which are arranged above the level of the packages, whether in the form of bottles or trays, in order to execute, for example operations such as filling and closing the packages.

A type of packaging line of food products in plastic trays or similar material is one in which the product to be packaged is deposited on the trays and the trays are subsequently closed with a covering film or sheet which is fixed to the cited tray by thermosealing, achieving a hermetic closure, it being possible to previously apply an inert gas different from air in the interior of the tray such as nitrogen or carbon dioxide. In order to apply the film, a tool arranged above the trays in a thermosealing station is used.

In this type of line, the trays run via conveyor means in a row, one behind the other and aligned according to the forward direction of the conveyor means which drive them to the thermosealing station in which a lower mold is arranged and an upper countermold (provided with heater means for thermosealing) between which a band of thermosealable sheet is interposed which will be applied respectively on the upper edges of the trays for the hermetic closure of the food content. The lower mold is provided with a determined number of consecutive cavities arranged in a row according to the same alignment which the trays follow on the conveyor means in order to house in each cavity one respective tray prior to proceeding to cover it with the sheet and to applying pressure and heat coming from the movement of the upper countermold when it fits over the lower mold in each work cycle.

What is notable is that in order to place a determined number of open trays from the conveyor means and deposit them in the corresponding cavities, the thermosealing station is provided with consistent transfer means in parallel crossbeams which are situated one at each side of a section of the row of trays arranged on the conveyor means, there being in each section as many trays as there are cavities in the lower mold. In order to transfer the trays to the lower mold, the crossbeams approach each other until they secure the group of trays and are displaced together in the same direction which the conveyor means follow, taking the trays with them until they deposit them in the respective cavities of the lower mold, the crossbeams then separating to release the trays and so as not to interfere with the closing of the upper countermold on the lower mold. While the trays are closed, the crossbeams return to locate the following group of trays.

This manner of proceeding has the drawback that the higher the number of trays to be closed simultaneously, the greater the length of the crossbeams has to be and more time will be used in the transfer of the trays to the thermosealing station. Sometimes it is not feasible to increase the speed of the transfer means to reduce the transfer time since some food products housed in the trays may release liquids (such as meat) or paste products and these may end up spilling over the upper edge of the trays which subsequently prevents the trays from closing correctly by thermosealing since residues remain between the upper edge of the tray and the plastic sheet to be applied.

Another drawback is related to the supply of the film used to close the trays by thermosealing. The more trays that it is desired to close in unison, the greater the transport distance of the film from the standby position thereof to the operating position thereof will be since the film is fed in the forward direction of the packages.

In order to overcome these and other drawbacks, machines have been developed equipped with various thermosealing devices working in parallel, by means of which all the trays pass through a product filling device in a row, after which the path is divided into various paths each one of which drives a series of trays to a corresponding thermosealing station. Consequently, these machines are very complicated and costly due to the increase of the sealing devices, of having to provide a distributor for the diversion of trays through different paths and the need for a considerable volume for the installation of the packaging machine.

Another alternative consists of the conveyor means of the trays being already compartmentalized, each compartment executing the function of lower mold to cooperate with an upper mold in the thermosealing station. In this case, the compartmentalization may be in a matrixed manner in the conveyor means and consequently the upper mold in the thermosealing station may be arranged transversal to the forward direction of the conveyor means to work during each machine stroke on a column of trays. This alternative rapidly loses interest for being poorly versatile. For example, it requires a very high number of lower molds of which the majority will be returning empty, in addition to requiring the replacement of all the molds if the format of the trays changes.

In the packaging of bottles, the packaging lines which use rotary type machines are common in which the bottles follow a circular path and advance in an intermittent manner from one station to the next, said stations being distributed static along the circular path; or in which the bottles advance in a continuous manner, in this case the stations being mounted in the machine such that they accompany the packages in the path thereof. In this last case, the stations may be prepared for carrying out more than one operation on the package or associated packages. Alternatively, it is necessary to transfer the packages from one rotary machine to another by means of transfer wheels or similar when it is necessary to change the operation to be executed on the packages. In any case, it is evident that these lines are not versatile and that they cannot be easily adapted when the format of the packages changes, i.e. from bottles; when it is necessary to increase the capacity of the line or add/change the operations which have to be carried out on the packages. In addition to the foregoing, the layout of these types of lines or the space required for the implementation thereof is a drawback added to the poor versatility which the lines offer.

DESCRIPTION OF THE INVENTION

The work station object of the invention is of the type which comprises an apparatus prepared for executing a certain simultaneous action on packages of an alignment of trays by means of the use of a tool with capacity to be arranged above the level of the packages, such as a group of injectors or dispensers for carrying out a filling operation; a lid or film applicator for carrying out closing operations; an injector group for carrying out sterilization operations; or part of a mold for enclosing the packages in a water-tightness testing operation.

The work station is, however, prepared for moving the packages to be processed to the apparatus and the packages processed from the apparatus, the packages being grouped in parallel alignments, said alignments being transported in unison and according to a path normal to that of the cited alignments.

To this end, the apparatus comprises a package transfer mechanism with a first transport group which is responsible for moving an alignment of packages to be processed from a delivery area to the apparatus; and with a second transport group which is responsible for moving an alignment of packages already processed from the apparatus to an output area. As will be seen, in the delivery and output areas, there may be two delivery and output conveyors, for example in the form of belt conveyors; or in the case that the work station comprises more than one apparatus, said delivery and/or output areas may, in turn, be output and/or delivery areas of another apparatus arranged upstream and/or downstream, respectively and in the forward direction of the rows of packages of the same work station.

Both first and second transport groups extend transversal to the forward direction of the alignments and in order to optimally carry out its purpose the work station is prepared to move, if necessary, the first transport group, the second transport group or both below the tool of the apparatus and from one side to another of the same.

For such purpose, the transport group which must be moved below the cited tool hangs by the ends thereof from both parts of the mechanism movable in parallel planes of movement and outside of the projection of the cited tool as if it were a swing, even in an inverted manner.

In essence, the work station is thus characterized in that the transfer mechanism is prepared to displace successive alignments of packages to be processed and processed packages, said alignments being arranged parallel to each other and the transport direction being perpendicular to that of said alignments, the mechanism comprising a first and a second transport group arranged transversal to the forward direction of the alignments of packages capable of simultaneously providing the insertion and removal to and from the apparatus, respectively, of the alignments of packages to be processed and processed packages when they are actuated in coordination, of which at least one of said first and second transport groups hangs by the ends thereof from two parts of the movable mechanism in parallel planes of movement and which do not interfere with the vertical projection of the tool of the apparatus by means of which the coordinated movement of these movable parts may impress on the cited first or second transport group a movement with a path which passes below the tool of the apparatus without interfering with the same.

Advantageously, the successive alignments of packages which pass through the work station may be transported below the tool of the apparatus following a direction perpendicular to that of the alignment, thereby obtaining the advantages of being able to arrange as many packages as there are in an alignment under the tool of the work station in each work cycle with minimum displacement; and at the same time being able to remove from below the tool the same quantity of packages with minimum displacement. When the packages are advanced in rows perpendicular to the transport direction in the work station, all the displacements are considerably reduced, thus increasing the rate of the line.

In one variant of the invention, the movable parts of the transfer mechanism from which the first and/or second conveyor group hang are capable of impressing on said conveyor group(s) a movement according to a path which comprises a section which runs below the tool of the apparatus from one side to another of the same, that is to say from the side on which the alignment of packages to be processed is received to the side on which the alignment of packages already processed is removed.

In this way, the alignment of processed packages may be displaced outside of the area of influence of the tool, being pushed from behind, this expulsion operation being able to be significantly simplified.

According to one embodiment of the work station, the first transport group comprises an introducing crosspiece prepared for cooperating in the transport of the alignment of packages to be processed to the apparatus, pushing said alignment of packages from the delivery area; and the second transport group comprising an expulsing crosspiece which cooperates in the transport of the processed packages from the apparatus pushing said alignment of packages to the output area, the ends at the same side of said introducing and expulsing crosspieces being securely fastened to the same movable part of the mechanism to provide the simultaneous actuation thereof.

In one optimal variant for packaging lines which use bottle type packages, the introducing and extractor crosspieces are provided with a series of supports, in a number at least equal to that of the packages in the alignments of packages, with a concave surface which carries out a self-centering effect of the packages in each support when the crosspieces are applied on an alignment of packages.

Advantageously, the transfer mechanism is versatile and may be used with bottles with different sizes and more particularly with different diameters. Irrespective of the diameter, the distance between centers of the packages of the same alignment do not vary and therefore they are arranged in the appropriate position for the tool to be able to carry out the corresponding function on them without it having to be adjusted (for example having to vary the distance between injectors in the case of a filling station). At the same time, the packages of the alignment of processed packages are delivered in an indexed manner that is, maintaining a distance to each other according to the arrangement and shape of the supports provided on the expulsing crosspiece.

The invention envisages the arrangement and shape of the supports being capable of being different in the introducing crosspiece and the expulsing crosspiece such that the processed packages may be arranged maintaining a distance to each other different to the distance which they maintained when they were transported to the apparatus of the work station. This allows the work station to be able to be connected with another work station that requires a different distance between packages due to the characteristics of the tool of this other work station.

In one optimal variant for stations that have to capture the packages in order to hold them suspended, which allows, for example obstacles in the path in the direction to or from the apparatus of the work station to be overcome or for the packages to be able to be arranged within a cavity or in a lower member of the tool at a different level with respect to the level that the row of packages to be transferred or transferred packages occupies, the first and the second transport groups comprise a closing crosspiece displaceably mounted with respect to the introducing and expulsing crosspiece respectively, with the capacity to approach and move away from the latter in order to carry out a clamping function and equipping the mechanism with the capacity to capture the alignments of packages in order to transport them suspended.

The actuation of the transfer mechanism may be implemented using known techniques. For example, the invention envisages that the movable parts of the transfer mechanism, from which at least one of the conveyor groups hangs, are directed, in the movement thereof, by a Cartesian robot preferably to be selected from between a T-gantry system or a Delta 2D robot.

The invention envisages that the actuation is duplicated such that each movable part, from which one end of the conveyor group(s) hangs, is actuated by a Cartesian robot, the work station thus comprising two Cartesian robot one at each side of the tool of the apparatus which are naturally actuated in coordination in order to together move the movable parts from which the conveyor group(s) hang. Alternatively, the station may use one single motorized Cartesian robot placed at one side of the tool of the apparatus in order to move the movable part from which one end of the conveyor groups hangs and may comprise a driven Cartesian robot which supports the moveable part from which the other side of the conveyor groups hangs with a transmission system suitable for moving this movable part.

In one variant of the invention, the tool of the apparatus is a movable tool, vertically displaceable with respect to a lower member and capable of adopting at least two positions of which one is an elevated position which does not interfere with the transport path of the alignments of packages towards or from the apparatus; and the other is an operating position suitable for manipulating or processing the alignment of packages placed in the apparatus; and at least the second transport group is dimensioned to be able to pass between the tool and the lower member at least when the tool is arranged in the elevated position.

The invention envisages, in this line, that the work station consists, for example of a station for closing packages equipped with a device supplying a common closing element or various individual closing elements between the tool and the lower member of the apparatus and above the alignment of packages placed in the apparatus, the cited common closing element or where appropriate the individualized closing elements being supplied in a direction perpendicular to the direction of the alignment of packages.

With the closing element or elements being of a film type, this application is optimal for closing trays by thermosealing of the film.

Preferably, the supply direction of the common closing element or, where appropriate, of the individual closing elements is contrary to the transport direction of the alignment of packages to and from the apparatus of the work station.

In relation to the lower member of the apparatus, it can be adapted to form with the tool, when the tool and the cited lower member are arranged applied one against the other, a series of cells each one suitable for housing a package of the alignment of packages placed on the apparatus.

At the same time, the lower member may also be movable and have the capacity to be displaced vertically in order to approach or move away from the tool of the apparatus.

In this line, the work station may consist, for example of a water-tightness testing station equipped with means for subjecting the space enclosing the cells formed by the tool and the lower member of the apparatus to a pressure-controlled atmosphere and with means for detecting variations of pressure in the interior of said space.

In a preferred embodiment, the station is equipped or is completed with a delivery conveyor and an output conveyor of packages in a row to be processed and processed packages which have sections that coincide with the delivery area and output area, respectively, of the work station which are arranged parallel to each other and to the alignment of packages in the apparatus of the station. In this way, various work stations may be concatenated, protection panels being capable of being arranged to close the packaging line in a simple manner and have easy access to the components of the apparatus.

In another embodiment, the work station comprises more than one apparatus, there being at least one first and one second apparatus such that the output area of the first apparatus is the delivery area of the second apparatus.

In another embodiment, the work station comprises more than one apparatus, there being at least one first and one second apparatus such that the delivery areas of the first and second apparatuses are parallel and adjacent to each other and that the output area of the first and the second apparatus are also parallel and adjacent to each other.

According to another aspect of the invention, a packaging line with modular construction is made known which utilizes the advantages of providing a work station according to the invention.

A packaging line may comprises at least two work stations according to the invention connected by means of a conveyor with intermittent forward movement on which the second transport group of a first work station delivers the alignment of processed packages in said first station and from which the first transport group of a second work station takes the same alignment of packages for the processing thereof.

This allows the work stations to be arranged with respect to each other, adopting different configurations, being adapting to the space in the plant and saving space with respect to the previous proposals. Evidently, the work stations may carry out different functions.

In a preferred form in which the stations require a different cycle time in order to carry out the function thereof on the packages the line comprises n+1 work stations according to the invention connected by means of a conveyor with intermittent forward movement via which:

the second transport group of a first work station delivers the alignment of processed packages in said first station in each work cycle lasting (t) and from which the first transport groups of n work stations take both alignments of packages arranged consecutively on the conveyor for the processing thereof in each work cycle lasting (T), fulfilling the relation n*t=T and being n>=2 or via which the second transport groups of n work stations deliver the alignment of processed packages in said first and second stations one behind the other spatially in each work cycle (T) and from which the first transport group of another work station takes successive alignments of packages for the processing thereof in each work cycle (t), fulfilling the relation n*t=T and being n>=2.

Advantageously, by adjusting the execution times of the work stations such that they are a multiple of the execution time of the quickest work station, it is possible to combine work stations in the line which carry out operations which require different execution times without requiring storage buffers between the work stations.

In general, t being the execution time of the quickest work station, the packaging line incorporates n work stations which require an execution time T, fulfilling the relation T=n×t.

According to an arrangement of interest, the transport direction of the alignments of packages through the respective transfer mechanisms in at least two of the work stations is parallel; the transport direction preferably being opposed in said at least two work stations.

BRIEF DESCRIPTION OF THE DRAWINGS

In the attached drawings, some embodiments of the invention of interest are illustrated in an exemplary, non-limiting manner. In said drawings.

DETAILED DESCRIPTION OF THE INVENTION

Figure 1:
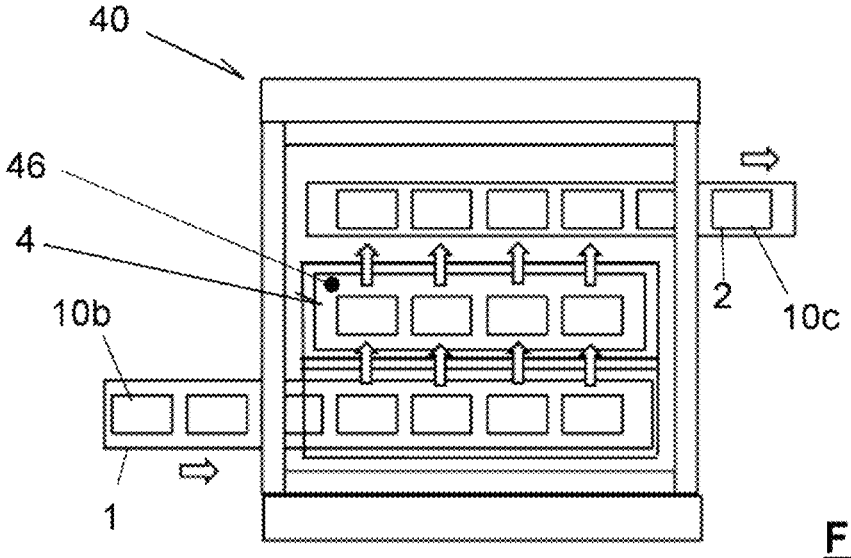
FIG. 1 is a schematic plan view of a work station with an apparatus which uses a tool for closing packages of the type in the form of a tray.

FIG. 1 schematically shows the plan of a work station 40 according to the invention applicable to a packaging line. This work station 40 comprises an apparatus 4 prepared for executing a determined action on the packages 10*b* which are supplied to it and more specifically it is capable of executing said action simultaneously on alignments of four packages.

The apparatus 4 is of the type which uses a tool 46 arranged above the packages in order to manipulate or execute a determined action on the packages and which therefore operates from above the packages. This tool 46 has been depicted transparently in FIG. 1 in order to show the passage of the packages below the same.

The apparatus 4 may be, for example a package closing apparatus; an apparatus for removing oxygen contained in the packages; an apparatus for testing the water-tightness of the packages; an apparatus for filling the packages with a product; etc.

FIG. 1 is illustrative of the flow which the packages follow when passing through the work station 40 and especially for illustrating how the packages are organized in alignments of four and they are transported in a direction perpendicular to the direction which the alignments follow including the passage thereof through the apparatus 4 and in particular below the tool 46 of said apparatus 4. This allows, as will be explained below, packaging lines to be implemented in a modular manner, concatenating different work stations 40.

In order to be able to organize the passage of the packages organized in alignment as is illustrated in FIG. 1, it is necessary to be able to displace the successive alignments of four packages below the tool 46 of the apparatus 4 without the means which provide the transport of the packages interfering with this tool 46. This task is carried out by a package transfer mechanism which is exemplified in the embodiments which are described below.

Figure 2:
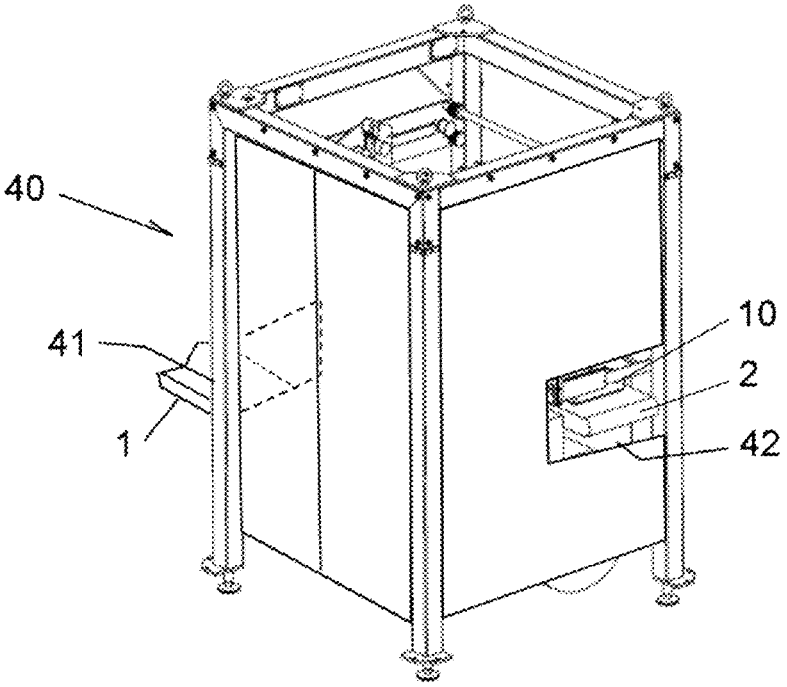
FIG. 2 is a perspective view of a work station according to an embodiment of the invention.
Figure 3:
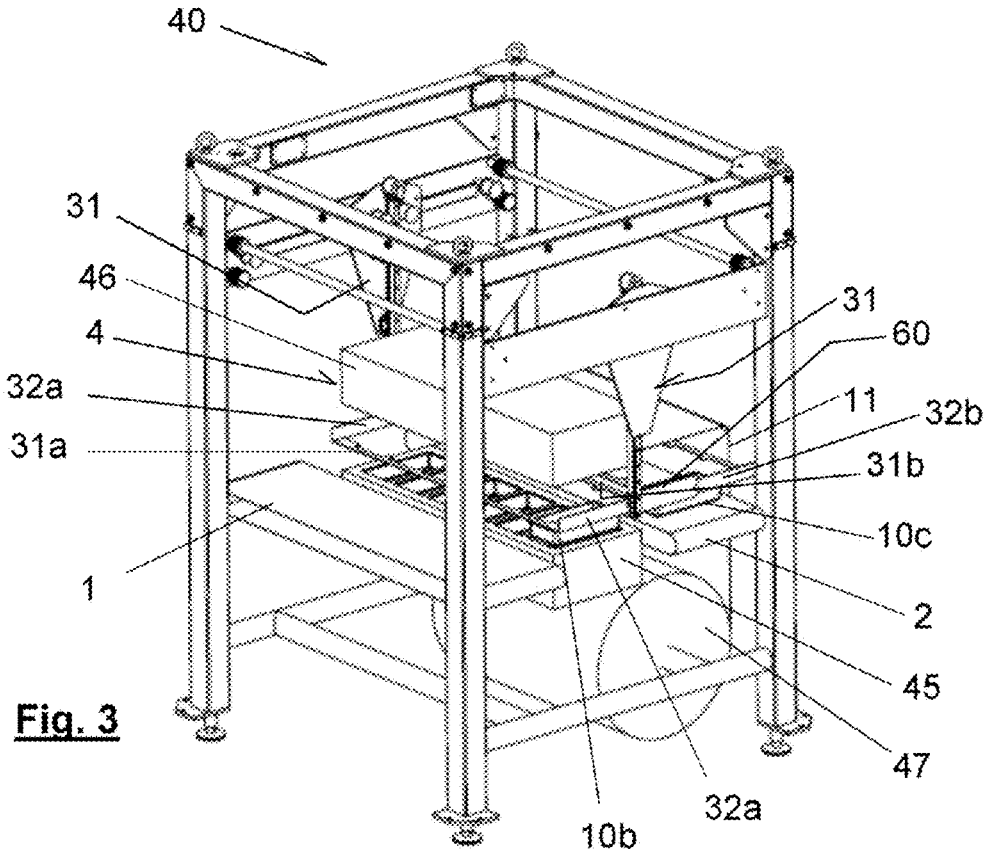
FIG. 3 is the work station of FIG. 2, devoid of the protector panels in order to show the transfer mechanism and the relation thereof with the tool of the apparatus.

FIGS. 2 and 3 show an example of a work station 40 suitable for the closing of packages 10 in the form of trays by means of a sheet 11 (see FIG. 3) which is applied and thermosealed on the upper edge of the packages 10.

As is observed in FIG. 2, the work station 40 comprises a frame which determines an inlet 41 through which a plurality of packages to be individually closed can be fed by means of a delivery conveyor 1, formed for example by a belt conveyor preferably with intermittent movement, the packages to be closed 10*b* previously referred to being aligned and arranged on the delivery conveyor 1 one behind another and evenly separated from each other, aligned according to the forward direction of the delivery conveyor 1 as the diagram of FIG. 1 illustrates; and an output 42 through which the closed packages 10*c* will be delivered by means of an output conveyor 2, formed for example by another belt conveyor with continuous or intermittent movement as the diagram of FIG. 1 also illustrates. The movable parts of the work station 40 are protected by panels which extend between the vertical mounts of the frame and in which the inlet and output 41 and 42 previously referred to are formed.

FIG. 3 shows the same work station 40 without the protection panels, the essential parts of the work station 40 being able to be shown.

The work station 40 comprises a supply device 47 of the continuous thermosealable sheet 11 used for closing the packages in the form of a tray and an apparatus 4 for closing packages which comprises a lower member 45 and a tool 46 which operates from above on the packages between which a portion of sheet 11 is successively arranged which is used for closing an alignment of packages to be closed 10*b*.

In the example, the supply device 47 comprises, in a known manner, a rotary axis which mounts a sheet roll 11 and various deflection rollers. However, it must be noted that the sheet roll is located below the apparatus 4 so that the work station 40 is more compact.

The tool 46, the lower member 45 or both are capable of being moved vertically in order to approach and move away from each other and are prepared to jointly form, when they approach each other, a row of cells suitable for housing respective packages 10*b* to be closed of an alignment of packages, thus thermosealing the sheet 11 on said packages. To this end, as is known, the apparatus 4 has means for supplying heat suitable for melting the sheet portions 11 in contact with the upper edges of the packages.

FIG. 3 allows the package transfer mechanism 31 to be shown in the work station 40 which provides the displacement of a first transport group 31*a* of packages, configured for capturing an alignment of packages to be closed 10*b*, situated on the delivery conveyor 1 and for transferring said alignment of packages to be closed 10*b* following a direction normal to the alignment to the closing apparatus 4 between the lower member 45 thereof and the tool 46 when the latter is arranged in an elevated position with respect to the lower member 45; and a second transport group 31*b* of packages, configured for capturing an alignment of packages already closed 10*c* arranged between the lower member 45 and the tool 46 of the closing apparatus 4 and for transferring said alignment of closed packages 10*c* following a direction normal to the cited alignment from the closing device 4, when the upper tool 46 of the latter is arranged in an elevated position with respect to the lower member 45, to the output conveyor 2 of closed packages 10*c*.

Advantageously, the transfer mechanism 31 simultaneously actuates the first and the second transport groups 31*a* and 31*b* of packages such that while the first transport group 31*a* captures the alignment of packages to be closed 10*b* from the delivery conveyor 1 and transfers it to the closing device 4, the second transport group 31*b* captures the alignment of closed packages 10*c* situated in the closing device 4 and transfers it to the output conveyor 2.

As is observed in FIGS. 1 to 3, the delivery and output conveyors 1 and 2 are arranged in this particular example parallel to each other and are actuated such that they transport the packages to be closed 10*b* and closed packages 10*c* according to the same forward direction. As is described below, other variants are also envisaged.

The first and the second transport groups 31*a* and 31*b* are arranged transversal to the forward direction of the alignments of packages in the station 40 from the delivery conveyor 1 towards the output conveyor 2 and are capable of simultaneously providing the insertion and the removal to and from the apparatus 4, respectively, of the alignments of packages to be processed 10*b* and processed packages 10*c* when they are actuated in coordination.

In order to not interfere with the apparatus 4, it is observed that the first and the second transport groups 31*a* and 31*b* hang by the ends 32*a* and 32*b* thereof from two movable parts 60 of the transfer mechanism 31 which are actuatable in planes of movement at each side of the apparatus 4 and which therefore do not interfere with the vertical projection of the apparatus 4 and especially of the tool 46 of the cited apparatus 4, therefore they are capable of arranging and moving the first and the second transport groups 31*a* and 31*b* below the tool 46 of the apparatus 4 without interfering with it.

In the example of FIGS. 2 and 3, the movable parts 60 of the transfer mechanism 31, from which the first and the second conveyor groups 31*a* and 31*b* hang, are directed, in the movement thereof, by two T-gantry type Cartesian robots.

Figure 4:
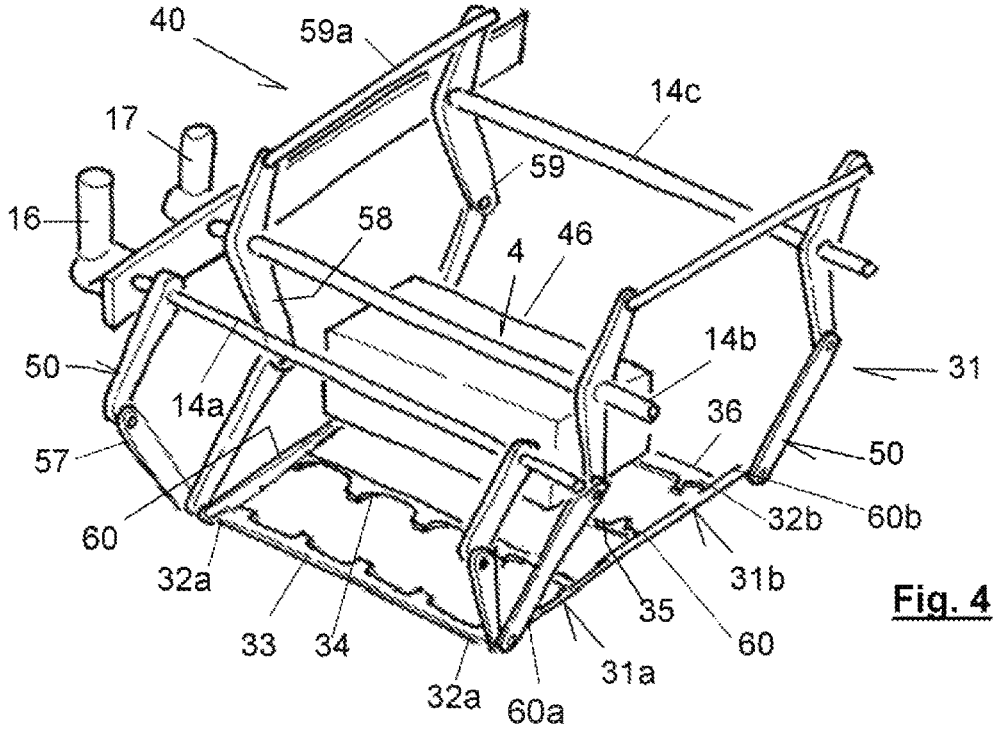
FIG. 4 is a schematic and perspective view of a transfer mechanism of packages for a work station according to the invention.
Figure 5:
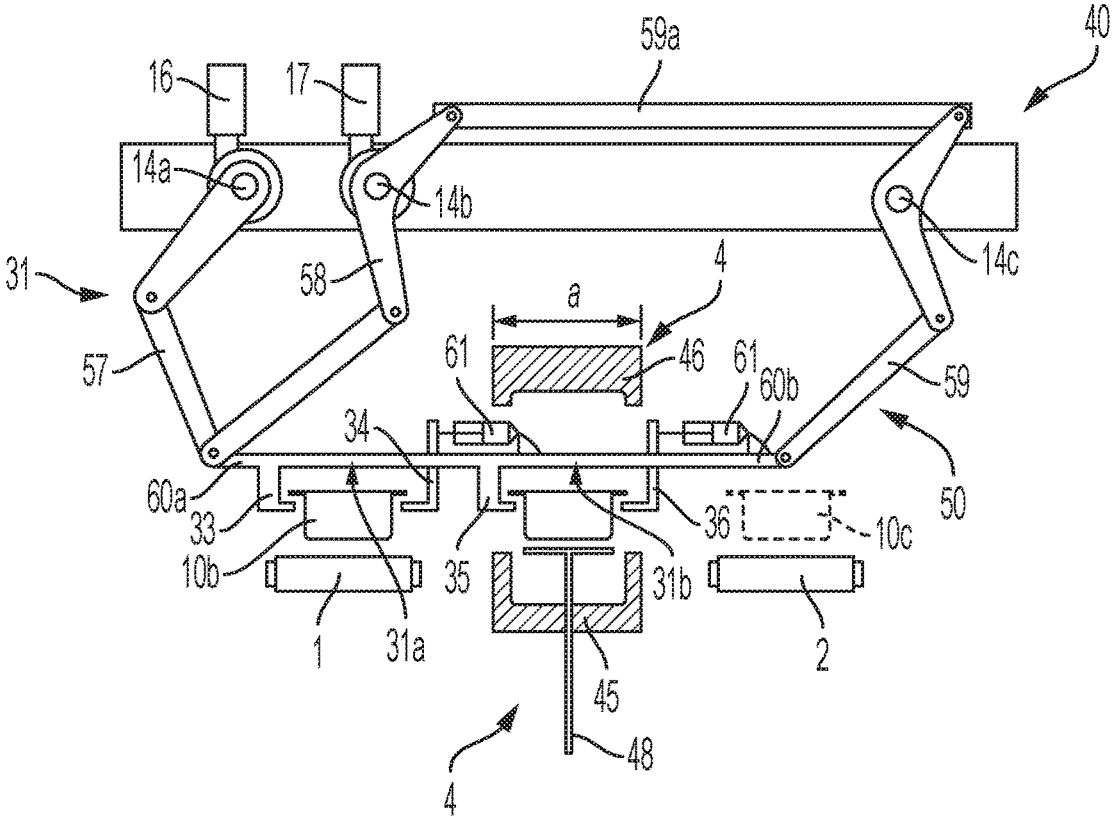
FIG. 5 is a lateral and schematic view of a work station similar to that of FIG. 3.

Making reference now to FIGS. 4 and 5, a work station 40 similar to that of FIGS. 2 and 3 is partially shown here, but the transfer mechanism thereof 31 is based on a Delta 2D type Cartesian robot.

In this work station 40 of FIGS. 4 and 5, the first transport group 31*a* of the transfer mechanism 31 comprises an introducing crosspiece 33 and an associated closing crosspiece 34 capable of approaching and separating from each other according to a direction normal to the alignment of packages to be closed 10*b*, adopting a holding position and a release position, respectively. The introducing crosspiece 33 and the associated closing crosspiece 34 thereof are prepared to, in the manner of a clamp, simultaneously capture the packages of the alignment of packages to be closed 10*b* and transport them to the deposit them between the lower member 45 and the tool 46 of the closing apparatus 4.

In turn, the second transport group 31*b* of the transfer mechanism 31 comprises an expulsing crosspiece 35 and an associated closing crosspiece 36 which are also capable of approaching and separating from each other according to a direction normal to the alignment of closed packages 10*c*, adopting a holding position and a release position, respectively. The expulsing crosspiece 35 and the associated closing crosspiece 36 thereof are prepared to, in the manner of a clamp, simultaneously capture the packages of the alignment of closed packages 10*c* situated between the lower member 45 and the tool 46 of the closing apparatus 4 and transport them to an output conveyor 2. It should be noted that in the final moments of the transfer operation of an alignment of packages to the apparatus 4 the closing crosspiece 36 must circulate between the tool 46 and the lower member 45 of the apparatus 4 whereas during the initial moments of the transfer operation of an alignment of packages from the apparatus 4 the expulsing crosspiece 35 must circulate between the tool 46 and the lower member 45 of the apparatus 4.

In the examples of FIGS. 4 and 5, the first and the second transport groups 31*a* and 31*b* of the transfer mechanism 31 each hang by the ends 32*a* and 32*b* thereof, respectively, from movable parts 60 in the form of crossbeams which are transported in two parallel planes of movements and arranged outside of the vertical protection of the closing apparatus 4, therefore they do not interfere with the latter and they allow paths to be impressed on the first and second transport groups 31*a* and 31*b* which pass from one side to the other of the closing apparatus 4 between the lower member 45 thereof and the tool 46 thereof without obstacles.

In the example of FIGS. 4 and 5, each one of the crossbeams 60 is guided in the movement thereof by two simultaneously actuated Delta 2D type Cartesian robots. Each Cartesian robot comprises an articulated structure 50 in a plane of movement, the link thereof with the associated crossbeam is as follows:

- A front end 60*a* of the crossbeam 60 is joined in a rotary manner to the connection point between a first articulated arm 57 inseparable from a horizontal motorized rotary axis 14*a* actuated by a first motor 16 and a second articulated arm 58 inseparable from another motorized rotary axis 14*b*, also horizontal, and actuated by a motor 17;
- A rear end 60*b* of the crossbeam 60 is joined, in a rotary manner to a third driven articulated arm 59 inseparable from a rotary axis 14*c* parallel to the motorized axes 14*a* and 14*b*, the cited third articulated arm 59 being connected to the second articulated arm 58 by way of a transmission in the example in the form of a bar 59*a*.

The coordinated rotation of the articulated arms 57 and 58 and thus of the driven articulated arm 59 in each articulated structure 50 impresses on the set of crossbeams 60 the movement required for the transport groups 31*a* and 31*b* to follow the desired path in the space.

The invention envisages that the distance between the introducing 33 and expulsing 35 crosspieces and the associated closing crosspieces 34 and 36 thereof can be varied. In the example, the introducing 33 and expulsing 35 crosspieces are fixed with respect to the crossbeams 60 while the associated closing crosspieces 34 and 36 are displaceable with respect to the crossbeams 60 such that they are capable of approaching or separating with respect to the introducing crosspiece 33 and the expulsing crosspiece 35, respectively. This characteristic has been depicted in FIG. 5 by means of the actuators 61 in the form of hydraulic cylinders here.

This solution allows the packages of the alignments of packages to be closed and closed packages 10*a* and 10*b* to be captured and held in a suspended manner such that the transfer mechanism 31 is suitable for situations in which the transport of the packages has to overcome a gap present between the delivery and/or output conveyors 1 and 2 and the position which the packages have to adopt in the closing apparatus 4.

Although it is not depicted, the invention envisages an embodiment in which the introducing 33 and expulsing 35 crosspieces are movable with respect to the movable parts 60 (in the present case in the form of crossbeams) while the associated closing crosspieces 34 and 36 are fixed with respect to said crossbeams 60.

In any case, the relative movement between each pair of crosspieces of the same transport group allows the apparatus 4 to be arranged in the operating position thereof, that is with the tool 46 in a position which fits over the lower member 45 in the present example, the expulsing crosspiece 35 and the associated closing crosspiece 36 thereof for example each being at one side of the apparatus 4 which economizes the execution time of a work cycle of the work station 40.

The different positions which the transfer mechanism 31 of the work station 40 of the examples of FIGS. 4 and 5 adopts in coordination with the movable parts of the closing apparatus 4 during a work cycle of a station 40 are described below, in this case equipped with a supply 47 and collection 47*a* device of sheet 11 each one at one side of the apparatus 4 and above the level of the packages.

Figure 6:
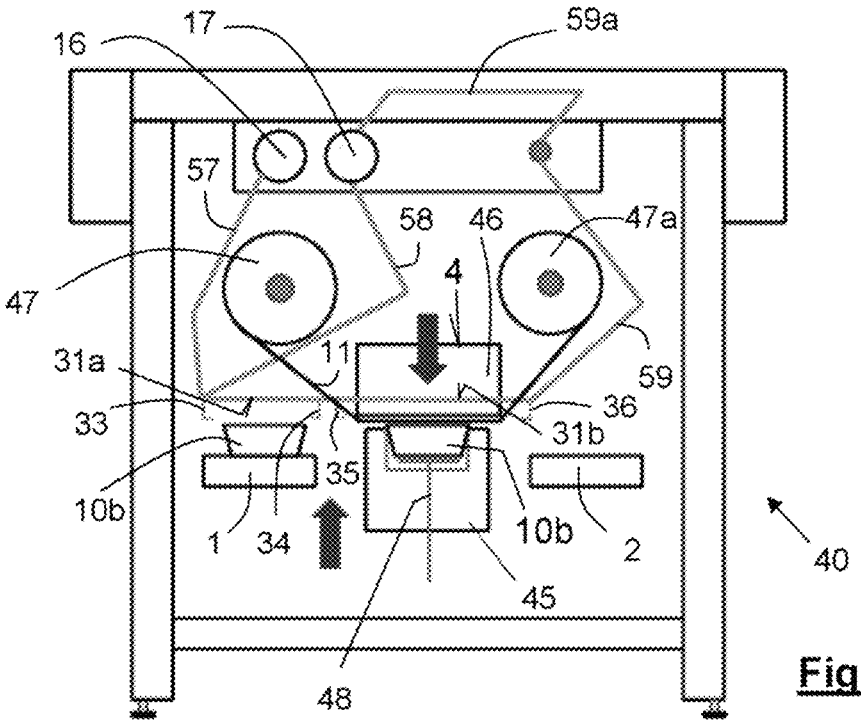
FIGS. 6 to 9 schematically show a sequence of a closing operation of packages by means of a work station similar to that of FIGS. 3 and 4.

FIG. 6 shows the operating position for closing by thermosealing of the apparatus 4 in relation to an alignment of packages arranged in the apparatus 4 which are being closed. As is observed, an alignment of packages 10*b* is housed in the lower member 45 of the apparatus 4, configured in the form of seat cavities while the upper edge of the packages on which a portion of sheet 11 is applied receives a supply of heat and pressure by means of the tool 46 which fits over said packages. At the same time as thermosealing of this alignment of packages 10*b* is carried out, the delivery conveyor 1 serves a new alignment of packages to be closed 10*b*.

It should be noted that in the position of FIG. 6, the first and the second transport groups 31*a* and 31*b* are elevated above the alignments of trays in the station 40, in addition to the introducing crosspiece 33 and the associated closing crosspiece 34 thereof being separated from each other, adopting a release position; and the expulsing crosspiece 35 and the associated closing crosspiece 36 thereof are also separated from each other, each one also adopting a release position, but at one side of the apparatus 4.

Figure 7:
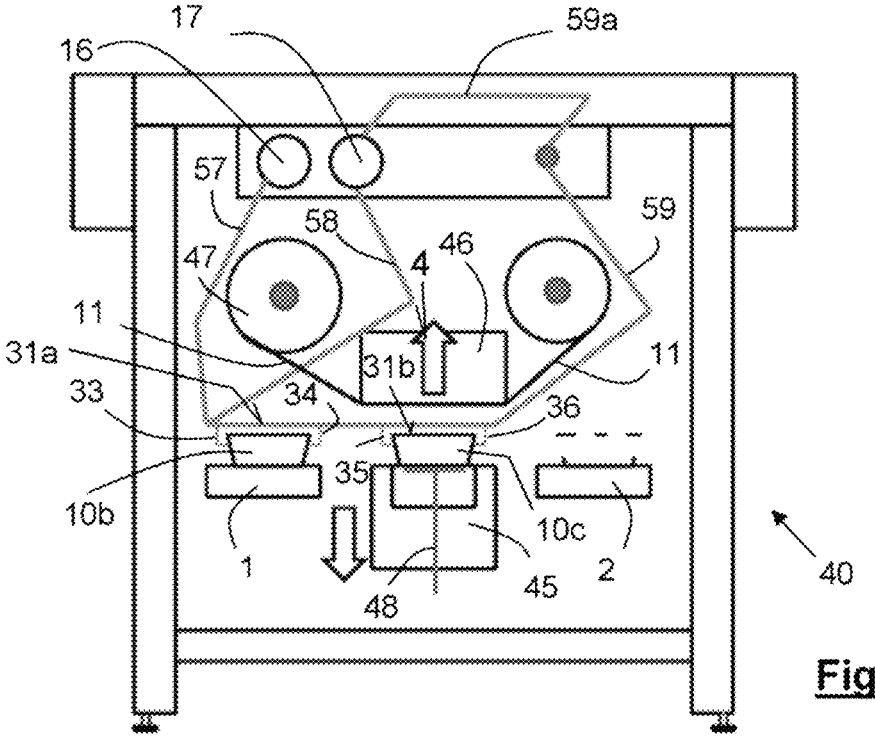

FIG. 7 shows a subsequent position in which the trays to be closed 10*b* and the closed trays 10*c* of two respective alignments are captured after the closing operation by thermosealing illustrated in FIG. 6. Both first and second transport groups 31*a* and 31 are in a lower position at the level of the packages, in addition to the introducing crosspiece 33 and the associated closing crosspiece 34 thereof approximating each other, adopting a holding position; and the expulsing crosspiece 35 and the associated closing crosspiece 36 thereof also approximating each other, also adopting a holding position.

In addition to the foregoing, it is observed that the tool 46 and the lower member 45 of the closing apparatus 4 have been separated, the tool 46 having been elevated and the lower member 45 having descended, while an ejector 48 maintains the closed trays 10*c*, especially the upper edge thereof, within the reach of the second conveyor group 31*b*.

Figure 8:
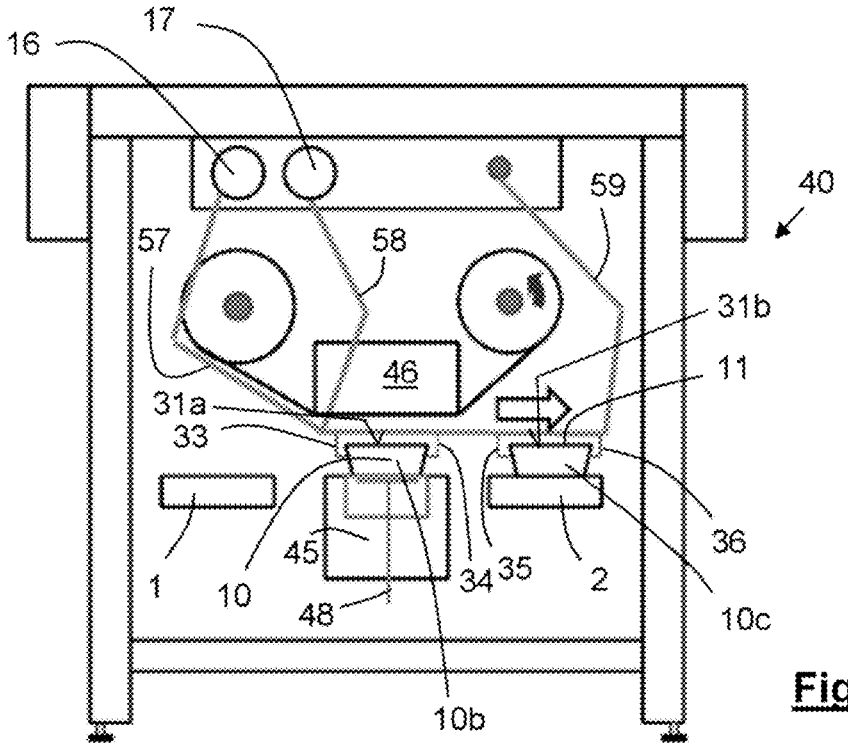

FIG. 8 shows what then occurs, the first and the second conveyor groups 31*a* and 31*b* having been displaced, transporting the packages in suspension in the direction normal to the alignment of trays until the new alignment of packages to be closed 10*b* reaches the closing apparatus 4 and the alignment of packages already closed 10*c* reaches the output conveyor 2.

Figure 9:
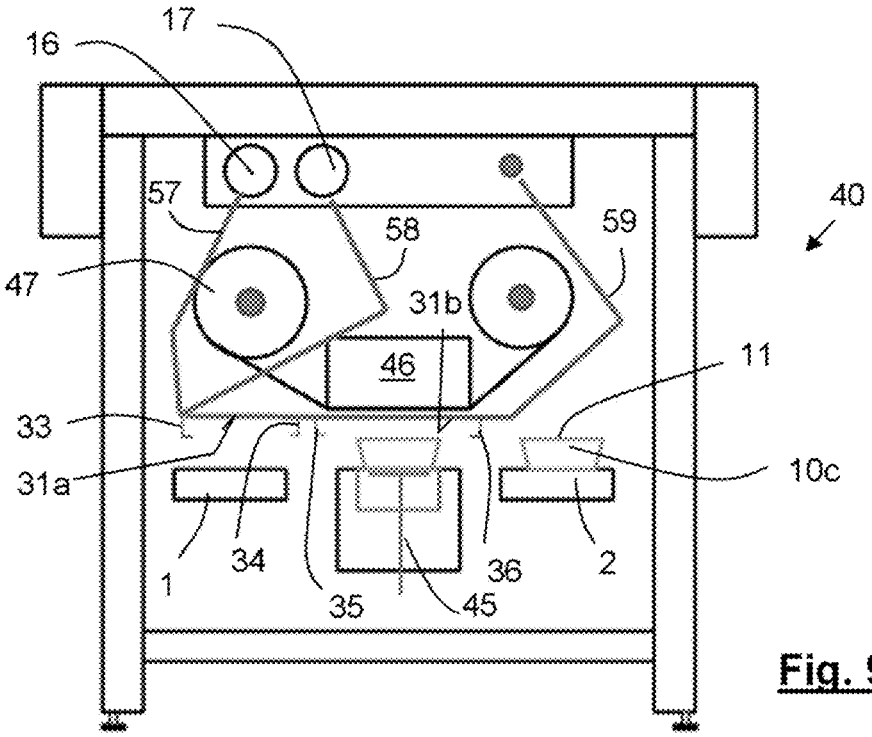

Subsequently, the transport groups 31*a* and 31*b* release the packages and re-adopt an elevated position suitable for being capable of being moved to return to the position illustrated in FIG. 9, suitable for capturing a new alignment of packages to be closed 10*b* and also for capturing the alignment of packages recently transferred to the apparatus 4 once they have been closed.

Figure 10:
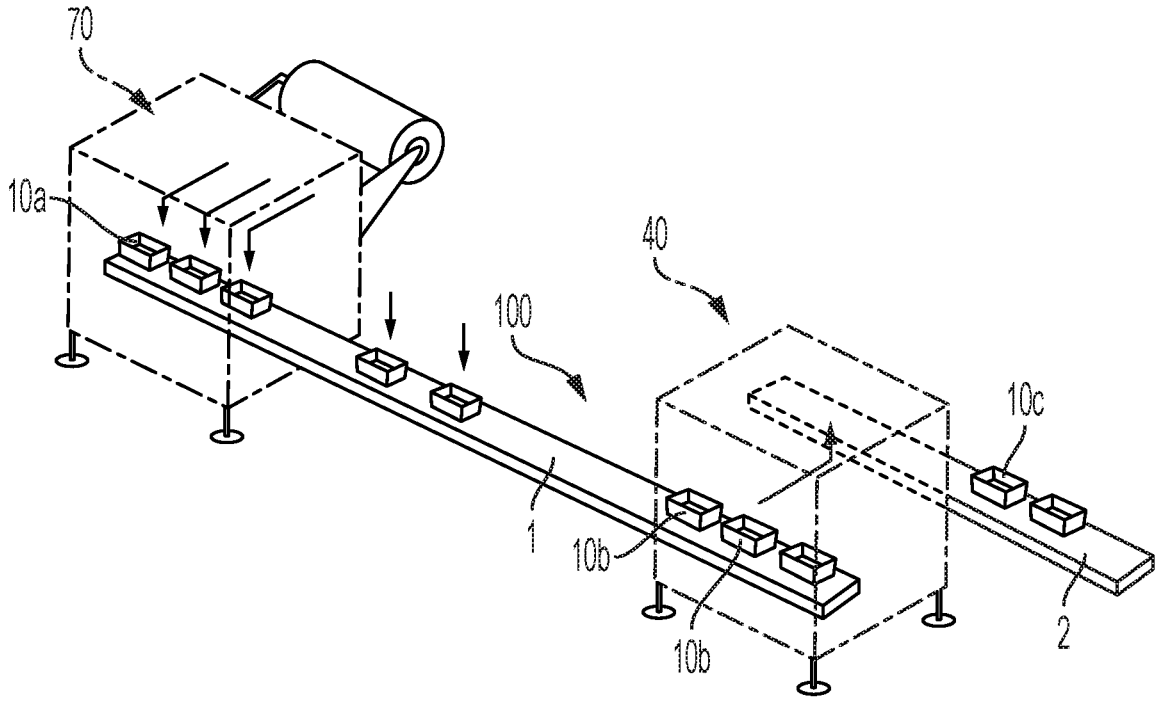
FIG. 10 is a perspective schematic view of a packaging line which comprises a work station for closing packages according to the invention.

The work stations 40 of FIGS. 2 and 3 or 4 and 5 are, for example suitable for carrying out an operation for closing packages 10 in a simple packaging process, schematically depicted by means of the packaging line 100 of FIG. 10, this exemplary process comprising the following basic operations;

- the delivery of an alignment of empty packages 10*a* in the form of a tray to a delivery conveyor 1 (for example in the form of a belt conveyor) which advances in a direction that coincides with that of the alignment of said empty packages 10*a* (in the example empty packages 10*a* manufactured by thermoforming).
- the filling of the packages to be closed 10*a* with products during the transport of these on the delivery conveyor 1 into a filling station;
- feeding, using the same delivery conveyor 1, the work station 40, prepared to remove from the delivery conveyor 1 an alignment of filled packages to be closed 10*b* formed by a number of consecutive packages on the delivery conveyor 1 at the rate of the capacity of the closing apparatus 4 of the work station 40 and transferring it to said closing apparatus 4 in a direction normal to the delivery conveyor 1;
- carrying out the operation for closing the alignment of packages transferred to the closing apparatus 4; and
- removing an alignment of already closed packages 10*c* from the closing apparatus 4 in a direction normal to the direction of the delivery conveyor 1 and transferring them to an output conveyor 2 parallel to the delivery conveyor 1 which advances in the same direction.

In the exemplary packaging line 100 the delivery of the empty packages 10*a* is carried out by means of a package thermoforming station 70 which, in turn, comprises various manufacturing lines in parallel which provide respective rows of thermoformed empty trays 10*a* aligned according to a direction substantially normal to the forward direction of the conveyor means 1.

As has been previously put forward, the work station 40 is suitable for any type of apparatus 4 different to a closing apparatus. For example, a work station 40' according to the invention would also be suitable for incorporating a watertightness testing apparatus 4', like the one schematically shown in FIG. 14, situated after a work station 40 with a closing apparatus 4.

Figure 11:
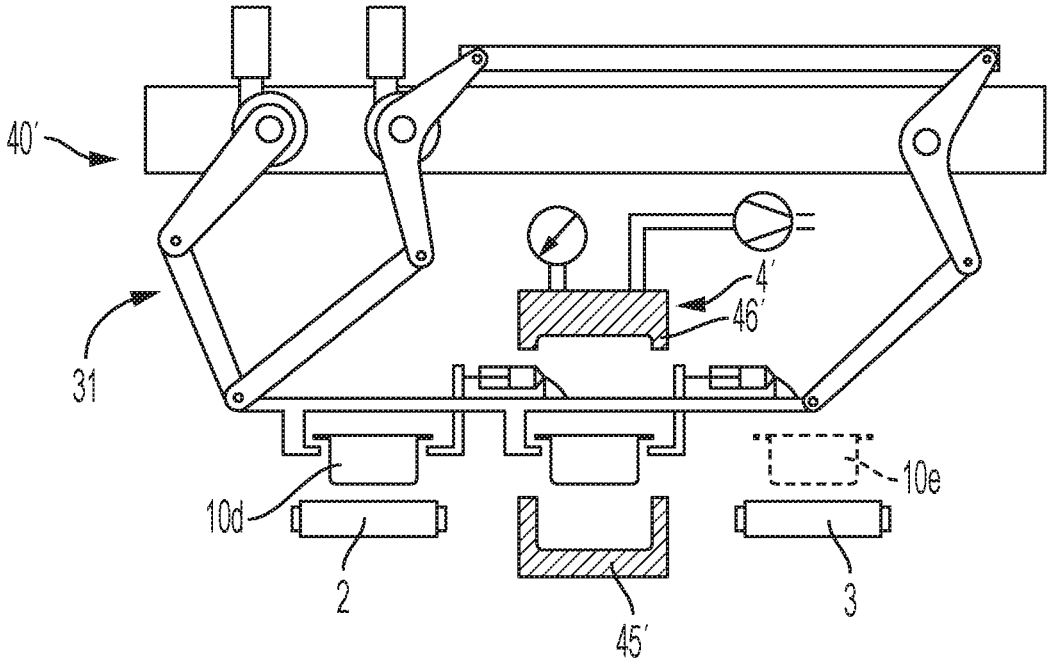
FIG. 11 is a schematic view of another work station, in this case for testing water-tightness which comprises a transfer mechanism similar to that of the work station of FIGS. 3 and 4.
Figure 12:
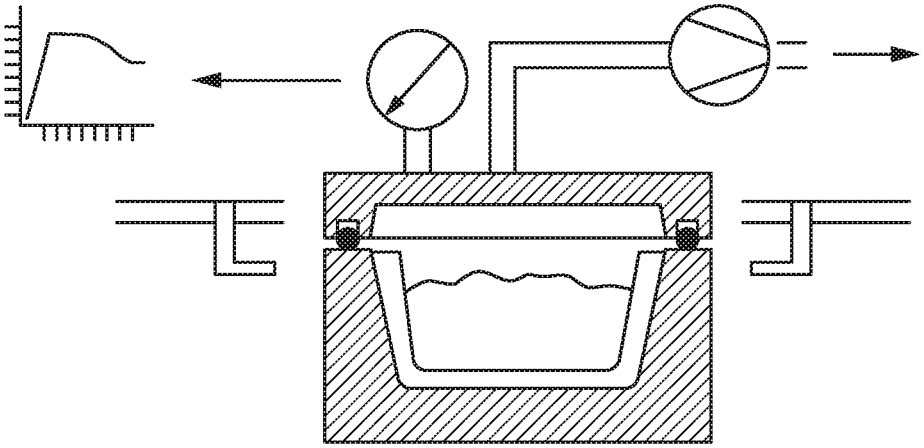
FIG. 12 schematically shows a detail of the apparatus of the work station of FIG. 11.

This work station 40', partially and schematically depicted in FIGS. 11 and 12 may comprise a testing apparatus 4' which includes a lower member 45' and an upper tool 46' capable of being moved vertically approaching or separating from each other, capable of being joined to form a tight internal cavity for housing, in the interior thereof, an alignment of closed trays pending testing 10*d* and a package transfer mechanism 31 similar to that of any of the work stations 40 illustrated in FIGS. 2 and 3 or 4 and 5.

Therefore, the testing apparatus 4' referred to, comprises, in the example, means for creating the hollow in the internal cavity in an operating position, that is to say, when the lower part 45' and the tool 46' are together and an alignment of closed trays to be tested 10*d* is housed in the internal cavity; control means of the time spent in creating the hollow; and means for each cell for detecting defects in the thermosealing if the time spent is greater than a reference value calculated for a correctly thermosealed alignment of trays of the same format as the closed trays to be tested 10*d* of the alignment object of the testing.

Figure 13:
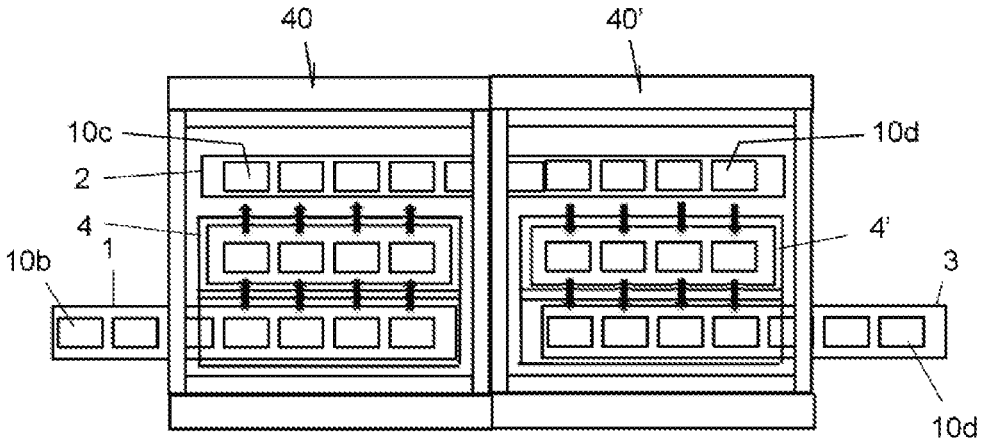
FIG. 13 is a schematic plan view similar to that of FIG. 1, but now of two concatenated work stations according to the invention.
Figure 14:
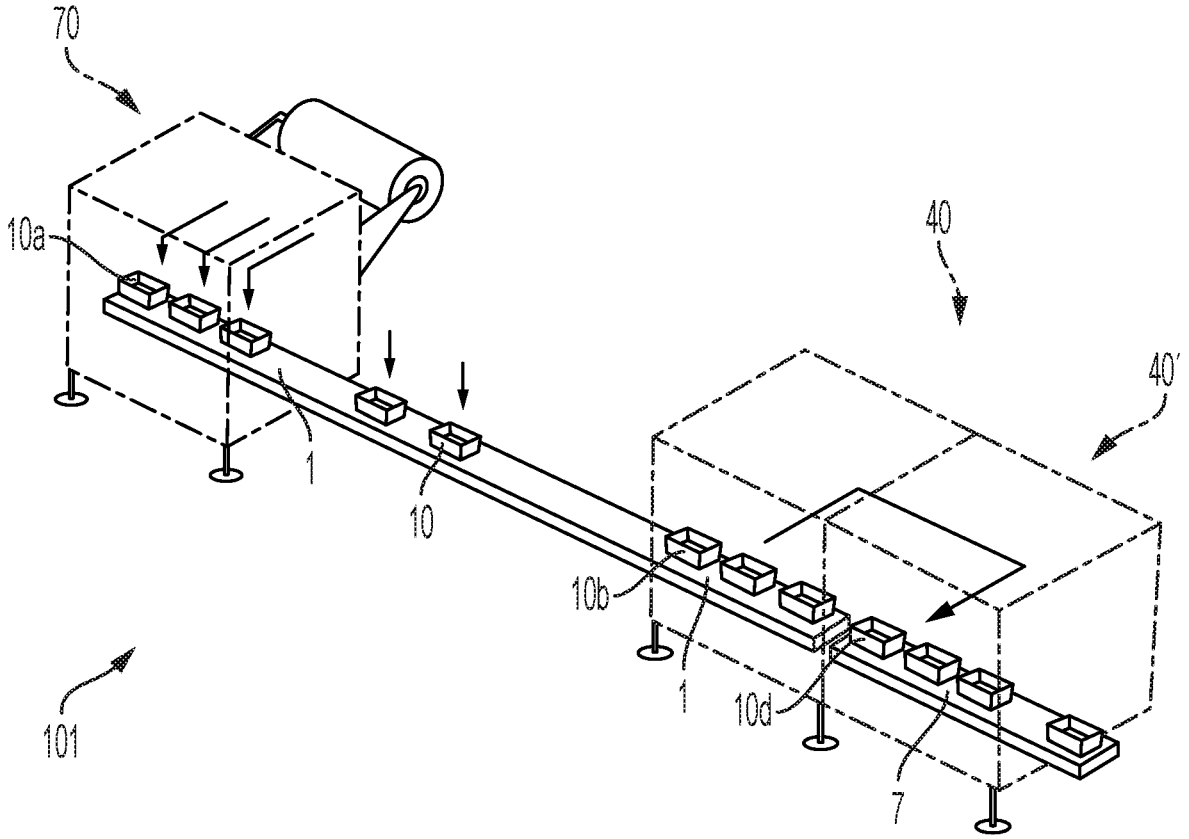
FIG. 14 schematically shows another packaging line which uses two work stations according to the invention.

The work stations 40 and 40' may be arranged concatenated such that the output conveyor 2 of the work station 40 is used as the inlet conveyor of the work station 40' as FIGS. 13 and 14 schematically illustrate.

In fact, as is observed in FIG. 13, the conveyor 2 of closed trays 10*c* in which the transfer mechanism of the work station 40 for closing packages has left closed aligned trays 10*c*, serves for supplying the testing work station 40'.

In this testing work station 40', the direction in which the packages are transported is contrary to that which the packages follow in the closing work station 40 upstream of the line, producing a very compact combined arrangement.

Figure 15A:
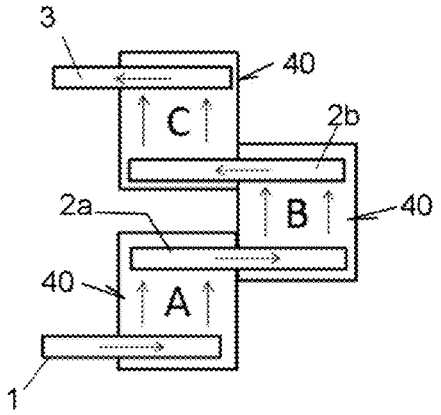
FIGS. 15*a*, 15*b* shows other alternative forms for concatenating two work stations according to the invention.
Figure 15B:
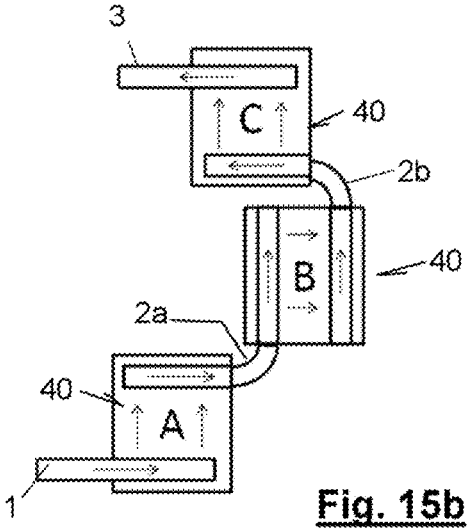

FIGS. 15*a* and 15*b* illustrate other possible variants for concatenating various consecutive work stations 40, in the examples three work stations 40A, 40B and 40C. In all of these, the alignments of packages are transported in a direction normal to said alignments, as the package flow arrows indicate in these FIGS. 15*a* and 15*b*. It should be noted that the sections of the conveyors 1, 2*a*, 2*b* and 3 which act as the connection between the work stations 40A, 40B and 40C in the areas of influence of the transfer mechanisms of each work station are parallel to each other and to the alignments of packages in the apparatuses 4 of said work stations.

Figure 15C:
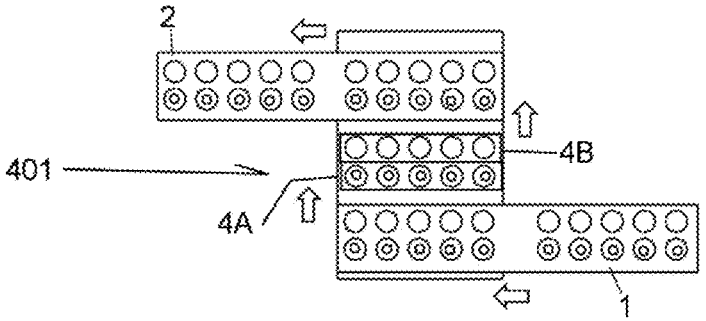
FIGS. 15*c* and 15*d* show alternative work stations with more than one apparatus.
Figure 15D:
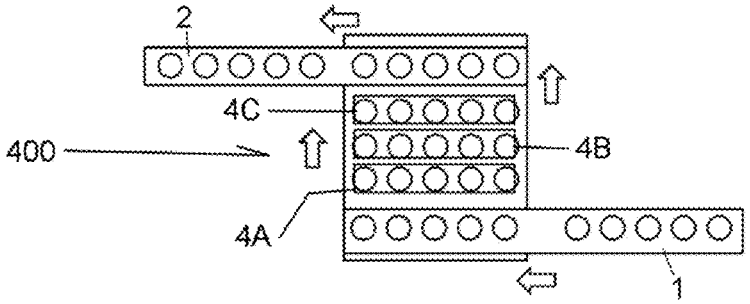

FIGS. 15*c* and 15*d* illustrate other variants envisaged by the invention. Specifically, FIG. 15*c* shows a work station 401 which comprises first and second apparatuses 4A and 4B such that the delivery areas of the first and second apparatuses are parallel and adjacent to each other and that the output area of the first and the second apparatus are also parallel and adjacent to each other. In this case, both delivery and output areas associated with each apparatus are each formed by the same conveyor 1 and 2, respectively, each with double capacity such that each conveyor moves two rows of parallel packages. This variant allows, in addition to doubling the capacity of a work station, for two different products to be obtained in the same line in a simple and spatially optimal manner.

FIG. 15*d* shows a work station 400 in which the output area of a first apparatus 4A is the delivery area of a second apparatus 4B; and in which the output area of this second apparatus 4B is the delivery area of a third apparatus 4C. This allows consecutive operations to be carried out on the rows of packages also in a simple and spatially optimal manner.

It is normal for the packaging lines to have to carry out even more operations on the packages and for the times required for executing each one of these operations to also be different.

In order to increase the production capacity, it is common to double the production lines or in order to absorb the bottle neck which an operation requiring more execution time may entail it is also common to divide a line to divert the packages towards two work stations which carry out the same operation on the packages supplied which are supplied by one work station upstream of the line and which works at greater speed.

The case arises whereby in order to execute this series of normal operations in a packaging line, in all of these a tool is used which operates above the packages since the packages are transported opened at the top.

Taking advantage of the flow which the packages follow in a work station according to the invention and of the fact that this work station is suitable for carrying out conventional operations on packages, it is possible to complete a packaging line playing with work stations according to the invention in the manner of a modular installation.

Figure 16A:
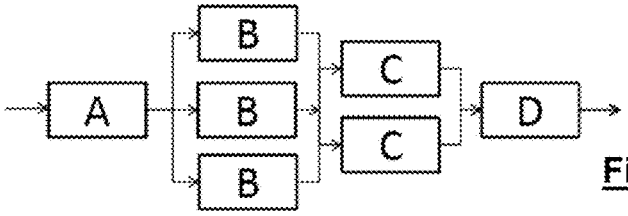
FIGS. 16*a*, 16*b* and 16*c* schematically show the spatial organization and tasks of a packaging line which uses seven work stations according to the invention with different cycle times and for carrying out up to four different tasks on the packages.
Figure 16B:
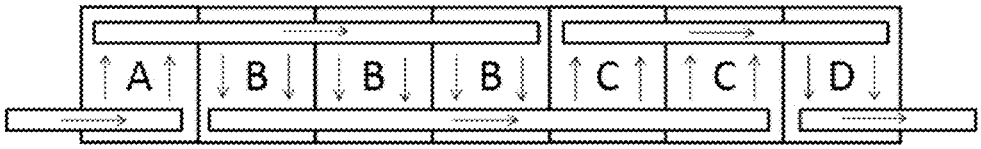
Figure 16C:
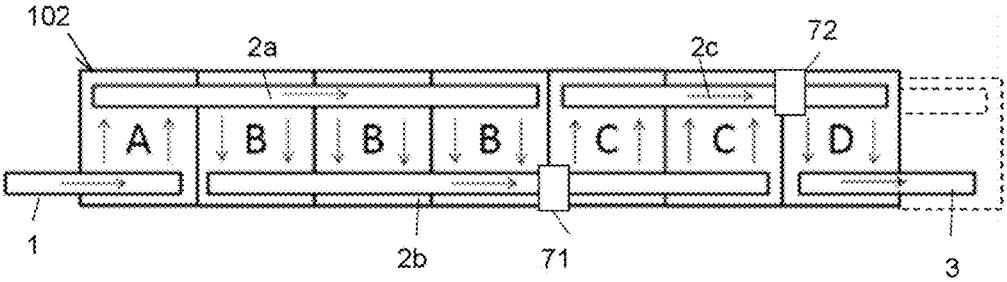

The examples of FIGS. 16*a*, 16*b* and 16*c* serve to illustrate the versatility which may be achieved taking advantage of the flow which the packages follow in a work station according to the invention.

In these examples, it is necessary to carry out, in a packaging line 102, up to four operations on the packages which require different execution times such as a disinfection operation, carried out by the work station 40A and which requires an execution time T; an operation for filling the packages, carried out by the work stations 40B and which requires an execution time 3*x*T; a closing operation, carried out by the work stations 40C and which requires an execution time 2*x*T; and a control operation, carried out by the work station 40D and which requires an execution time T.

Conventionally, in order to complete the packaging line, the packaging line is divided or storage buffers are used between work stations, just as work stations would have to be oversized if a production increase is required in the future.

The diagrams of FIGS. 16*b* and 16*c* show how the needs of this exemplary line may be resolved in a modular manner, using the work stations 40A, 40B, 40C and 40D arranged consecutively one after the other in order to better utilize the time and the space available.

In these examples, the same output conveyor 2*a* of the first work station 40A feeds the three work stations 40B. To this end, the times of the work cycle in the work station 40A are adjusted such that in each work cycle an alignment of packages is served to the output conveyor 2*a* with intermittent advance which, each time it receives a new alignment of packages, advances the equivalent distance in order to be able to receive a new alignment. During this time, that is to say, during the three work cycles of the first work station 40A, the three work stations 40B each carry out the corresponding operation on a number of packages like an alignment of packages.

The work stations 40B deliver the packages to the same output conveyor 2*b* which is used to feed the work stations 40C.

Figure 16D:
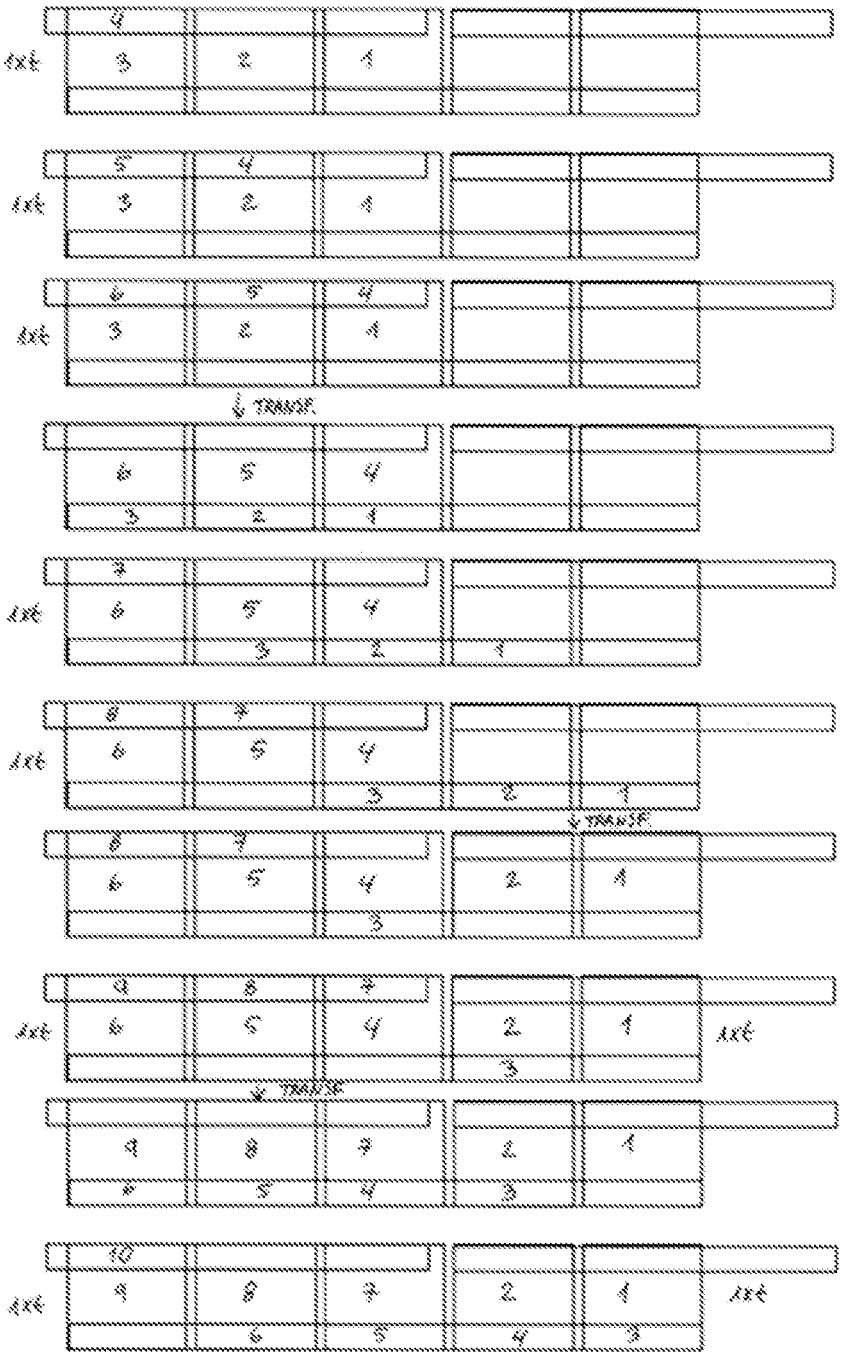
FIG. 16*d*, 16*e*, and 16*f* schematically show an advance sequence of a line which uses work stations with a different cycle or execution time which is adjusted to triple or double a predetermined t value.
Figure 16E:
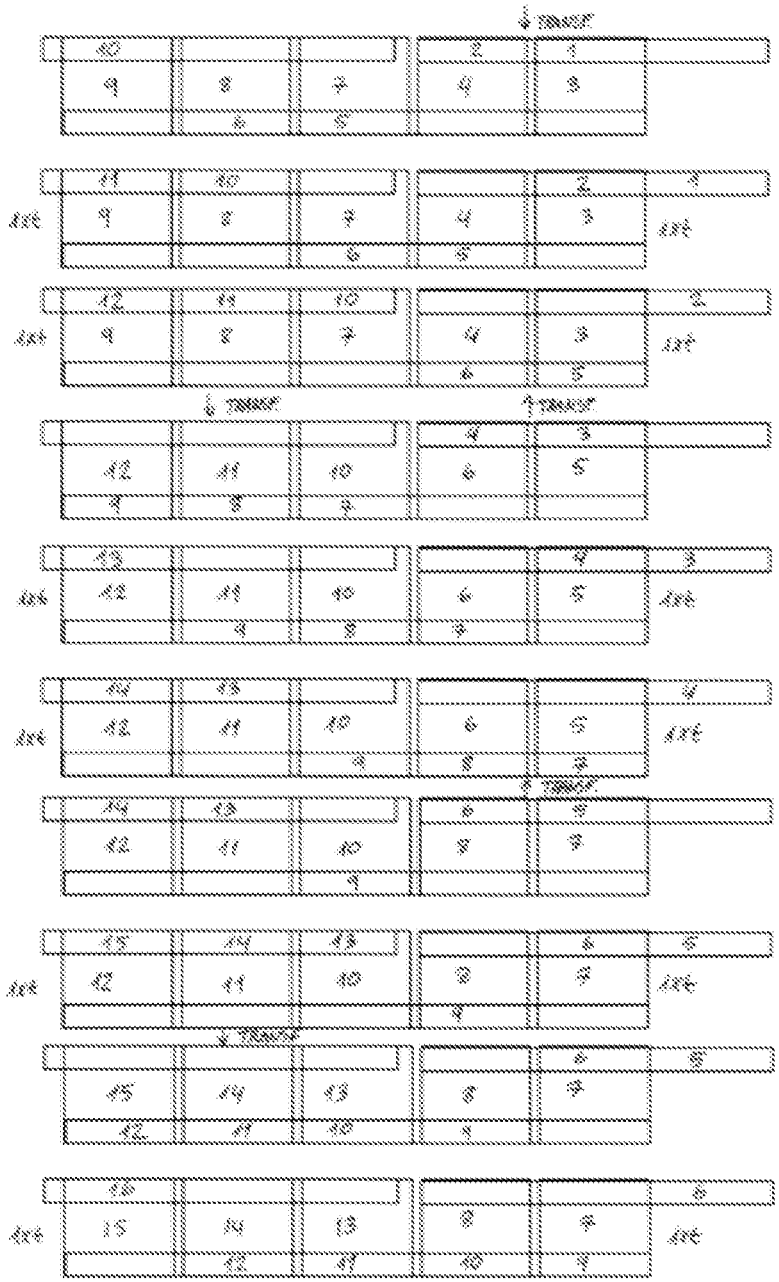
Figure 16F:
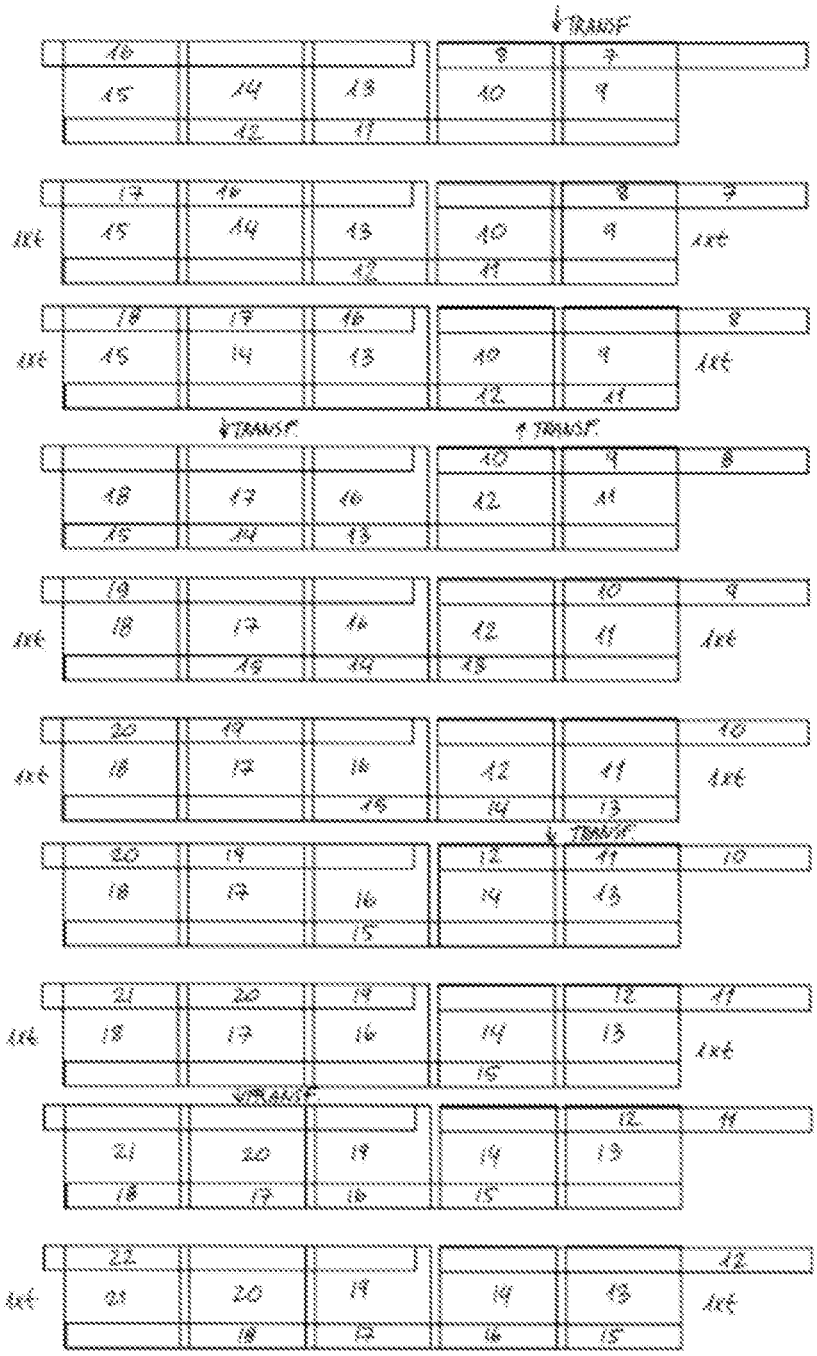

In the example of FIG. 16*b*, taking advantage of the fact that the execution times of the work stations 4B and 4C are multiples of the execution time of the quickest work station 4A, it is possible to feed the stations 4C without accumulating rows of packages. A practical example of an advance sequence between an equivalent arrangement which combines three stations with execution time 3*xt* with two stations with execution time 2*xt* is illustrated in FIG. 16*d-f*, consecutive numbers being used to indicate the rows of packages which sequentially enter and exit the packaging line.

At the same time, the execution time of the work station 40D is half the cycle time of the work stations 40C.

In the example of FIG. 16*c*, an alternative is illustrated in which the apparatuses of the stations 40C are configured for simultaneously processing an alignment of packages, the number of which is 1.5xE, E being the number of packages of an alignment of packages in the work stations 40B. The invention also envisages that the separation between the packages of an alignment of packages in the stations 40B and 40C may be different, for which a transfer 71 may be used, for example in the form of endless transfer or prepare the first conveyor groups of the stations 40C for such purpose, as will be explained below.

The process is similar between the work stations 40C and 40D. The apparatus of the work station 40D must be configured for operating on alignments of packages of a number equal to 3xE packages. It may or may not be required to again change the separation space between packages of the same alignment. In this sense, the FIG. 16*c* is schematic and the station 40D may be twice as long, as the broken line seeks to illustrate, in order not to have to change the separation space between packages in an alignment. Alternatively, another transfer 72 may be used; adapt the second conveyor group of the stations 40C; the first conveyor group of the station 40D or both second conveyor group and first conveyor group of the work stations 40C and 40D, respectively in order to carry out the change in a more sequential manner.

Figure 17:
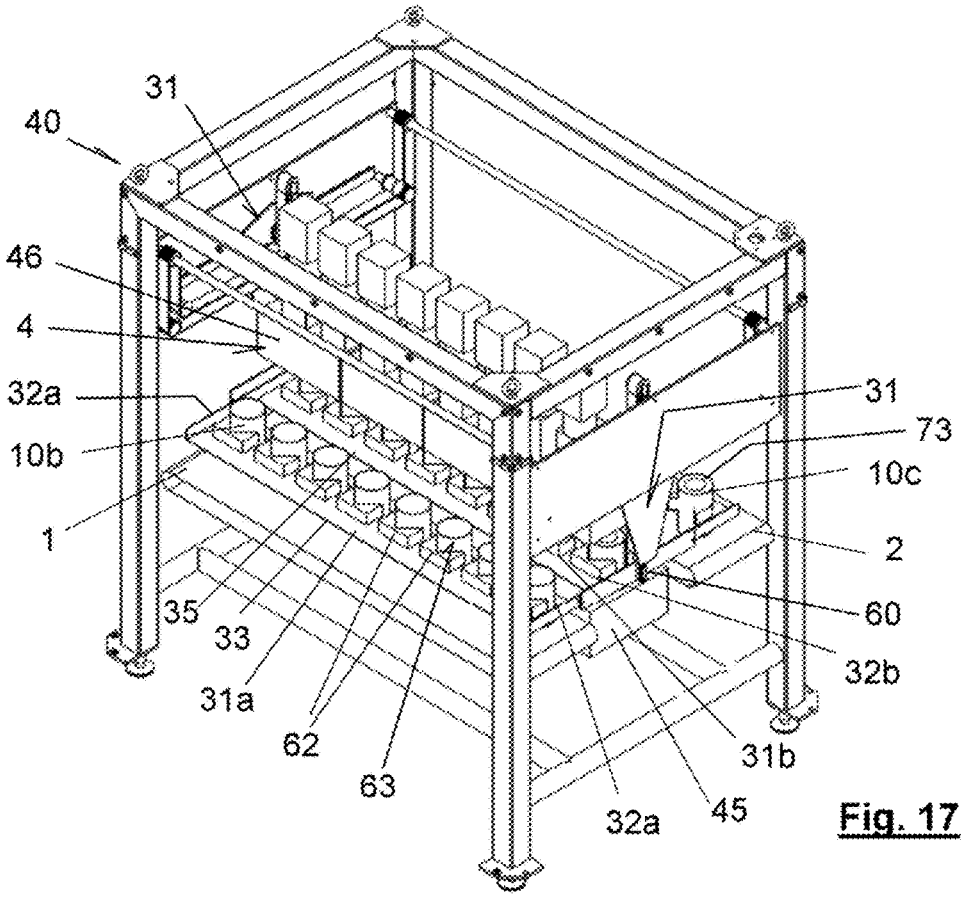
FIG. 17 shows a perspective view of another work station according to the invention especially suitable for bottle type packages and in which the movable parts of the transfer mechanism, from which the first and the second transport groups hang, are actuated by two T-gantry type Cartesian robots.

FIG. 17 shows another exemplary embodiment for a work station 40 according to the invention. In this case, the packages have a bottle shape or similar and the apparatus 4 comprises a tool 46 prepared to dispense and place covers 73 on each one of the packages of the alignment of packages which are arranged supported on a lower member 45 of the apparatus 4. In this FIG. 17, the same reference numerals are used as in FIGS. 2, 3 and 4, 5 for designing components which carry out an equivalent function.

In the example of FIG. 17, the movable parts 60 of the transfer mechanism 31, from which the first and the second conveyor groups 31*a* and 31*b* hang, are directed, in the movement thereof, by two T-gantry type Cartesian robots in a manner similar to the example of the work station 40 depicted in FIGS. 2 and 3.

Unlike the example of FIGS. 2, 3 and 4, 5, in this case it is not required to capture the packages in order to transport them suspended and the transport thereof towards and from the apparatus 4 may be carried out by simply pushing the same. Consequently; the first and the second conveyor groups 31*a* and 31*b* comprise two introducing 33 and expulsing 35 crosspieces without it being necessary to equip the first and the second conveyor groups with closing crosspieces for capturing the packages.

Figure 18:
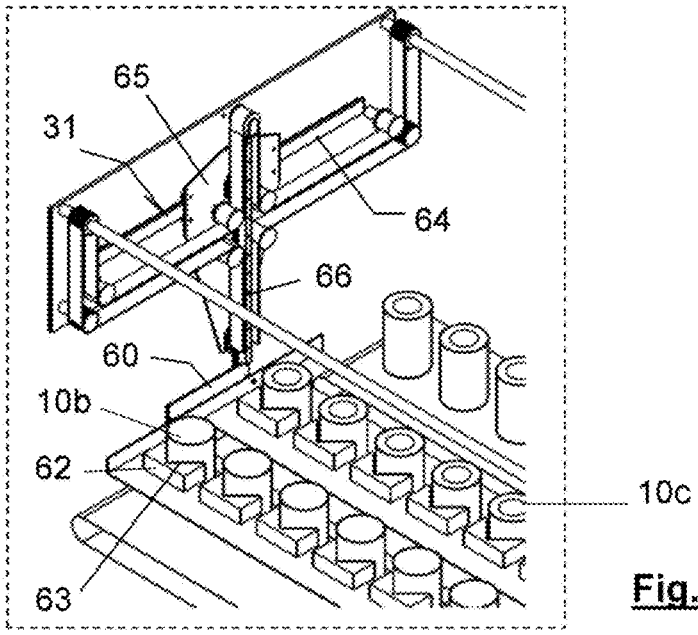
FIG. 18 shows a detail of FIG. 17, being devoid of the work station of the apparatus.

In FIG. 18, a part of the work station 40 devoid of the apparatus 4 has been depicted for showing more clearly the configuration of the introducing 33 and expulsing 35 crosspieces and specifically that these introducing 33 and expulsing 35 crosspieces are provided with a series of supports 62, in a number at least equal to that of the packages in the alignments of packages to be transported, with a concave surface 63, in the example formed by two straight walls which converge at an angle which carry out a self-centering effect of the packages, taking advantage of the fact that these have a circular section. The invention envisages taking advantage of this effect to change the separation distance between packages of an alignment of packages with respect to the distance which separates them prior to being pushed by any one of the transport groups 31*a*.

FIG. 18 also allows the Cartesian robot to be illustrated which provides the movement of one of the movable parts 60 of the transfer mechanism 31. This Cartesian robot, in a manner known per se, consists of a rail 64 on which a slide 65 is slid and to which the movable part 60 is going to be fixed.

Figure 19:
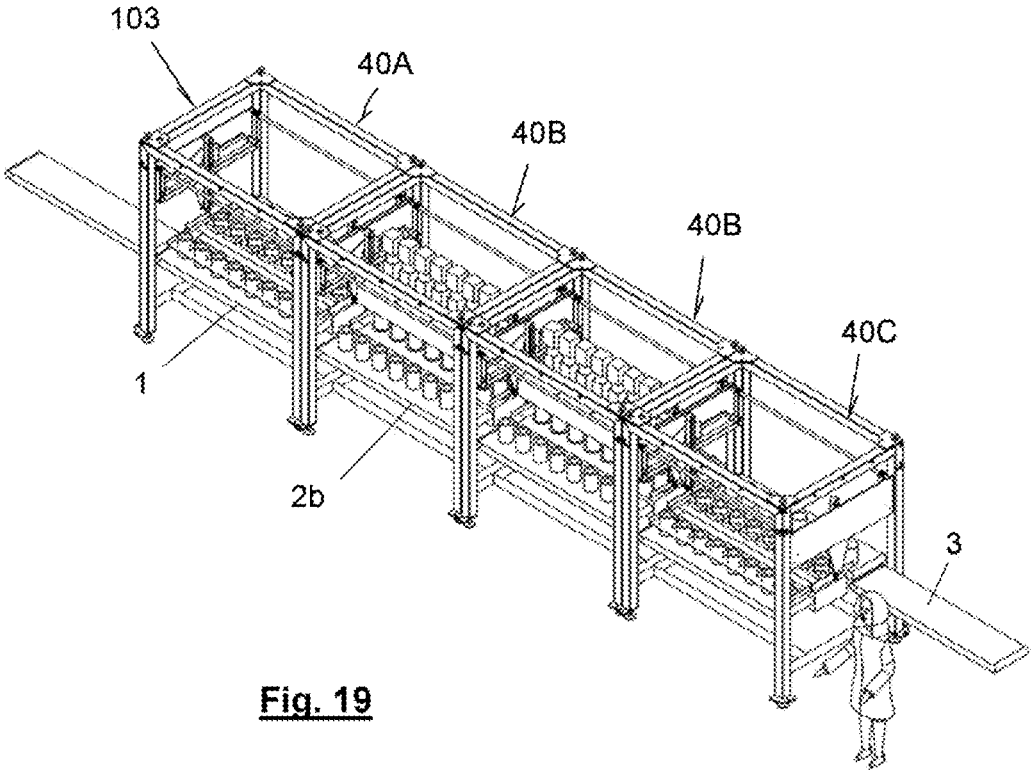
FIG. 19 shows another packaging line which uses a total of four work stations according to the invention.

FIG. 19 shows an example of a packaging line 103 which includes a total of four work stations of which the first, in the forward direction of the line, is a work station 40A with an apparatus which sterilizes the interior of the packages of successive alignments of packages which are aligned with the delivery conveyor 1; the two following work stations 40B provide the filling of the packages of two consecutive alignments of packages and which are supplied every two work cycles of the work station 40*a*, each work station 40B being responsible for the closing of one of said alignments of packages; and the last work station 40C corresponds to a station for closing the packages with capacity to operate on two alignments of packages which are supplied to it in an intermittent manner by the delivery conveyor 2*b* in the same period of time which each work station 40B requires to carry out the filling function thereof, the closed packages being delivered by the conveyor 3.

The invention claimed is:

1. A work station (40) for a packaging line which comprises an apparatus (4) prepared for executing a certain simultaneous action on packages (10) of an alignment of packages by means of the use of a tool (46) with the capacity to be arranged above the level of the packages; and a transfer mechanism (31) for the simultaneous transport of an alignment of packages to be processed (10*b*) from a delivery area to the apparatus (4) and of an alignment of processed packages (10*c*) from the apparatus (4) to an output area, wherein said transfer mechanism (31) is prepared for simultaneously moving the alignments of packages to be processed and processed packages (10*b*, 10*c*) along a transport direction within the work station, said alignments being arranged parallel to each other and the transport direction being perpendicular to that of said alignments, the transfer mechanism (31), comprising a first and a second transport group (31*a*, 31*b*) arranged transversely to the transport direction of the alignments of packages capable of simultaneously providing the insertion and the removal to and from the apparatus (4), respectively, of the alignments of packages to be processed and processed packages when actuated in coordination, of which at least one of the first or second transport group (31*a* or 31*b*) hangs by two opposing ends (32*b*) each one from a corresponding movable part (60) of the transfer mechanism (31) which are movable on respective parallel planes of movement and which do not interfere with the vertical projection of the tool (46) of the apparatus (4) by means of which the cited transfer mechanism (31) is capable of impressing on the cited first or second transport group (31*a* or 31*b*) a movement with a path which passes below the tool (46) of the apparatus (4) without interfering with the tool; and wherein the each transport group has a crosspiece that is configured to pass below the tool without interfering with the tool, the crosspiece longitudinally extending transversely to the transport direction of the alignments of packages within the work station.

2. The work station (40) according to claim 1, wherein the movable parts of the transfer mechanism (31), from which at least one or both of the first or second transport group (31*a* and/or 31*b*) hangs, are capable of impressing on said transport group(s) (31*a* and/or 31*b*) a movement according to a path comprising a section which runs below the tool (46) of the apparatus (4) from one side to another of the same.

3. The work station (40) according to claim 1, wherein the crosspiece for the first transport group (31*a*) is an introducing crosspiece (33) configured for cooperating in the transport of the alignment of packages to be processed (10*b*) to the apparatus (4), pushing said alignment of packages; and the crosspiece of the second transport group (31*b*) comprises an expulsing crosspiece (35) configured for cooperating in the transport of the processed packages (10*c*) from the apparatus (4) pushing said alignment of packages, ends (32*a*, 32*b*) at the same side of said introducing and expulsing crosspiece (33, 35) being securely fastened to the same movable part of the transfer mechanism (31) to provide the simultaneous actuation thereof.

4. The work station (40) according to claim 3, wherein the introducing (33) and expulsing (35) crosspieces are provided with a series of supports (62), in a number at least equal to that of the packages in the alignments of packages to be transported with a concave surface (63) which carries out a self-centering effect of the packages in each support (62) when the introducing and expulsing crossbeams (33, 35) are applied on an alignment of packages.

5. The work station (40) according to claim 3, wherein the first and the second transport groups (31*a*, 31*b*) each comprise a closing crosspiece (34, 36) displaceably mounted with respect to the introducing (33) and expulsing (35) crosspiece, respectively, with capacity to approach and move away from the latter in order to carry out a gripping or clamping function and equipping the transfer mechanism (31) with the capacity to capture the alignments of packages in order to transport them suspended.

6. The work station (40) according to claim 1, wherein the movable parts of the transfer mechanism, from which the second transport group (31*b*) hangs, are directed, in the movement thereof, by a Cartesian robot to be selected from between a T-gantry system or a Delta 2D robot.

7. The work station (40) according to claim 1, wherein the tool (46) of the apparatus (4) is a movable tool, vertically displaceable with respect to a lower member (45) and capable of adopting at least two positions of which one is an elevated position which does not interfere with the transport path of the alignments of packages towards or from the apparatus (4); and the other is an operating position suitable for manipulating or processing the alignment of packages placed in the apparatus (4); and at least the second transport group (31*b*) is dimensioned to be able to pass between the tool (46) and the lower member (45) at least when the tool (46) is arranged in the elevated position.

8. The work station (40) according to claim 7, comprising a station for closing packages equipped with a device supplying a common closing element (11) or various individual closing elements between the tool (46) and the lower member (45) of the apparatus (4) and above the alignment of packages placed in the apparatus (4), the cited common closing element (11), or where appropriate, the individualized closing elements being supplied in a direction perpendicular to that of the alignment of packages.

9. The work station (40) according to claim 8, wherein the supply direction of the common closing element (11) or, where appropriate, of the individual closing elements is contrary to the transport direction of the alignment of packages to and from the apparatus (4) of the work station (40).

10. The work station (40) according to claim 6, wherein the lower member (45) of the apparatus (4) is adapted to form with the tool (46), when the tool (46) and the cited lower member (45) are arranged applied one against the other, a series of cells each one suitable for housing a package of the alignment of packages placed on the apparatus (4).

11. The work station (40) according to claim 10, wherein the lower member (45) is movable and has the capacity to be displaced vertically in order to approach and move away from the tool (46) of the apparatus (4).

12. The work station (40) according to claim 11 the preceding claim, comprising a station for testing watertightness or vacuum chamber, equipped with means for subjecting the space enclosing the cells formed by the tool (46) and the lower member (45) of the apparatus (4) to a pressure-controlled atmosphere and with means for detecting variations of pressure in the interior of said space.

13. The work station (40) according to claim 1, equipped with a delivery conveyor (1) and an output conveyor (2) of packages in a row to be processed and processed packages, respectively, the sections of the delivery conveyor and of the output conveyor (1, 2) being arranged in the area of influence of the transfer mechanism (31) and coinciding with the delivery and output areas, respectively, of the work stations parallel to each other and to the alignment of packages in the apparatus (4) of the work station (40).

14. The work station (40) according to claim 1, wherein the work station comprises more than one apparatus (4A; 4B), there being at least one first and one second apparatus such that the output area of the first apparatus (4A) is the delivery area of the second apparatus (4B).

15. The work station (401) according to claim 1, wherein the work station comprises more than one apparatus (4A; 4B), there being at least one first and one second apparatus such that the delivery areas of the first and the second apparatuses are parallel and adjacent to each other and the output area of the first and the second apparatus are also parallel and adjacent to each other.

16. A packaging line (101, 102, 103) with modular construction which comprises at least two work stations (40A, 40B) according to claim 1 connected by means of a conveyor with intermittent forward movement (2) via which the second transport group (31*b*) of a first work station (40A) delivers the alignment of processed packages (10*c*) in said work station (40A) and from which the first transport group (31*a*) of a second work station (40B) takes the same alignment of packages for the processing thereof.

17. The packaging line (102, 103) which comprises n+1 work stations according to claim 1, connected by means of a conveyor with intermittent forward movement (2) via which:

the second transport group (31*b*) of a first work station (40A) delivers the alignment of processed packages (10*c*) in said first work station (40A) in each work cycle lasting (t) and from which the first transport groups (31*a*) of n work stations (40B, 40C) downstream of the packaging line take both alignments of packages arranged consecutively on the conveyor for the processing thereof in each work cycle lasting (T), fulfilling the relation n*t=T and being n>=2; or via which the second transport groups (31*b*) of n work stations (40*a*, 40D) deliver the alignment of processed packages (10*c*) in said first and second stations in each work cycle (T) and from which the first transport group (31*a*) of another work station (40E) downstream of the packaging line takes successive alignments of packages for the processing thereof in each work cycle (t), fulfilling the relation n*t=T and being n>=2.

18. The packaging line (101, 102, 103) according to claim 16, wherein the transport direction of the alignments of packages through the respective transfer mechanisms (31) in at least two of the work stations (40A, 40B) is parallel.

19. The packaging line (101, 102, 103) according to claim 18, wherein the transport direction of the alignments of packages is opposed in said at least two work stations (40A, 40B).

20. A method for manipulating packages (10) in a packaging line (100) which comprises at least one work station (40) prepared for executing a certain simultaneous action on an alignment of packages by means of the use of a tool (46) arranged above the level of the packages and a corresponding mechanism (31) for transferring successive alignments of packages to and from said work station (40), in which the successive alignments of packages are parallel to each other and are transported following a direction perpendicular to that of the formation of the alignments of packages, the method comprising the displacement below the tool (46) of the work station (40) in two stages and from one side to the other of the same of an alignment of packages by means of a first and a second transport group (31*a*, 31*b*) of the transfer mechanism (31), both arranged transversal to a transport direction of the packages in the work station (40).

* * * * *